US006619746B2

(12) United States Patent
Roslund, Jr. et al.

(10) Patent No.: US 6,619,746 B2
(45) Date of Patent: Sep. 16, 2003

(54) HEIGHT-ADJUSTABLE ROTATABLE CHAIR ARM

(75) Inventors: Richard N. Roslund, Jr., Jenison, MI (US); Gary Kiesgen, Muskegon, MI (US); Matthew B. Rutman, Grandville, MI (US); Larry A. Wilkerson, Comstock Park, MI (US); Robert Leonetti, Holland, MI (US)

(73) Assignee: Haworth, Inc., Holland, MI (US)

( * ) Notice: Subject to any disclaimer, the term of this patent is extended or adjusted under 35 U.S.C. 154(b) by 201 days.

(21) Appl. No.: 09/734,497

(22) Filed: Dec. 11, 2000

(65) Prior Publication Data

US 2002/0043863 A1 Apr. 18, 2002

Related U.S. Application Data

(63) Continuation-in-part of application No. 09/591,018, filed on Jun. 9, 2000, now abandoned.

(51) Int. Cl.[7] ..... A47C 7/54

(52) U.S. Cl. ..... 297/411.36; 297/411.31; 297/411.35; 297/411.37

(58) Field of Search ..... 297/411.35, 411.36, 297/411.37, 411.31

(56) References Cited

U.S. PATENT DOCUMENTS

| | | | | |
|---|---|---|---|---|
| 4,438,975 A | | 3/1984 | Williams | |
| 5,368,365 A | | 11/1994 | Feldberg | |
| 5,407,249 A | | 4/1995 | Bonutti | |
| 5,439,267 A | | 8/1995 | Peterson et al. | |
| 5,484,187 A | | 1/1996 | Doerner et al. | |
| 5,590,934 A | | 1/1997 | Gibbs | |
| 5,599,067 A | * | 2/1997 | Schuelke et al. | 297/411.35 |
| 5,641,203 A | | 6/1997 | Van De Riet et al. | |
| 5,749,628 A | | 5/1998 | Synder et al. | |
| 5,749,629 A | | 5/1998 | Heath et al. | |
| 5,752,683 A | | 5/1998 | Novis et al. | |
| 5,765,919 A | | 6/1998 | Karlsson et al. | |
| 5,839,786 A | | 11/1998 | Cvek | |
| 5,884,975 A | | 3/1999 | Su | |
| 5,908,221 A | | 6/1999 | Neil | |
| 5,931,536 A | | 8/1999 | Wu | |
| 5,931,537 A | | 8/1999 | Gollin et al. | |
| 5,971,484 A | | 10/1999 | Lamart et al. | |
| 6,139,107 A | * | 10/2000 | Lee | 297/411.36 |
| 6,209,961 B1 | * | 4/2001 | Chen | 297/411.36 |
| 6,296,312 B1 | * | 10/2001 | Congleton et al. | 297/411.35 |
| 6,394,553 B1 | * | 5/2002 | McAllister et al. | 297/411.36 |
| 6,460,932 B1 | * | 10/2002 | Kopish et al. | 297/411.36 |

* cited by examiner

*Primary Examiner*—Peter M. Cuomo
*Assistant Examiner*—Sarah C. Burnham
(74) *Attorney, Agent, or Firm*—Flynn, Thiel, Boutell & Tanis, P.C.

(57) ABSTRACT

A height-adjustable and rotatable chair arm for an office chair includes a rotatable sleeve that is rotatably connected to an upright support post of the chair, and an arm assembly supported on the sleeve. Rotation of the sleeve relative to the upright permits the chair arm to be rotated to a desired position. Additionally, the sleeve includes a vertical row of slots and the arm assembly includes a lock mechanism which engages the slots whereby the arm assembly is vertically slidable along the sleeve and lockable at a selected elevation to adjust the height of the chair arm.

27 Claims, 18 Drawing Sheets

HEIGHT-ADJUSTABLE ROTATABLE CHAIR ARM

This is a continuation-in-part of our application Ser. No. 09/591 018, filed Jun. 9, 2000, and entitled "HEIGHT-ADJUSTABLE ROTATABLE CHAIR ARM", now abandoned.

FIELD OF THE INVENTION

The invention relates to a chair arm for an office chair, and more particularly to a chair arm which is height-adjustable and rotatable.

BACKGROUND OF THE INVENTION

To improve the comfort of office chairs, chair arms thereon often are adjustable so that the position of its arm-supporting top cap can be adjusted to accommodate the specific physical characteristics of each user. In this regard, it is known to provide chair arms which are both height-adjustable to permit adjustment of the vertical height of the top cap, and also rotatable to provide further adjustability.

Examples of chair arms which are height-adjustable and rotatable are disclosed in U.S. Pat. Nos. 4,997,054, 5,599,067, 5,839,786, and 5,931,536. Another example of a height-adjustable and rotatable chair arm is disclosed in U.S. Pat. No. 5,647,638 which is owned by the assignee of the present invention and the disclosure which is incorporated herein in its entirety by reference.

The invention relates to an improved chair arm of this type. Each arm of the inventive arm arrangement includes a rigid upright support post which is connected to a seat assembly of the chair and projects upwardly from a respective side edge thereof. An arm assembly is connected to an upper end of the support post so as to be height-adjustable and rotatable relative thereto.

The arm assembly includes a vertically elongate sleeve which fits onto the upper end of the support post in rotatable engagement therewith such that the sleeve is rotatable relative to the support post about a vertical rotation axis. An arm housing is supported on the sleeve so as to be rotatable therewith, and also is vertically movable relative to the sleeve.

To control rotation, a detent arrangement is defined between opposing surfaces of the sleeve and the support post which arrangement defines multiple discrete stop positions which are angularly spaced apart from each other.

In one embodiment, the detent arrangement includes three predefined stop positions wherein the arm assembly is able to rotate through a 360 degree angular path so that the chair arm can extend forwardly or rearwardly. In a second embodiment, the stop positions extend about the entire 360-degree angular path in 10-degree increments.

In addition to being rotatable in combination with the sleeve, the arm housing also is vertically slidable along the sleeve to provide for height adjustment of the arm assembly. The sleeve includes a plurality of vertically spaced apart notches, while the arm assembly includes a manually-actuatable lock mechanism which engages the notches to maintain the arm assembly at a selected elevation relative to the sleeve. The lock assembly thereby is disengaged to permit raising of the arm housing relative to the sleeve to a desired elevation and then re-engaged with the notches to secure the arm housing at this elevation.

The second embodiment of the invention further includes a mounting bracket which is pivotally connected to the seat assembly. This pivot connection permits the entire chair arm to be pivoted outwardly and inwardly to a desired position whereby the rotatable arm housing of the chair arm permits the top cap to be repositioned so that it is maintained substantially parallel to the respective side edge of the seat assembly.

The chair arm arrangements of the invention thereby have a unique height-adjustable and rotatable arm arrangement which is less complex to assemble.

Other objects and purposes of the invention, and variations thereof, will be apparent upon reading the following specification and inspecting the accompanying drawings.

Figure 1:
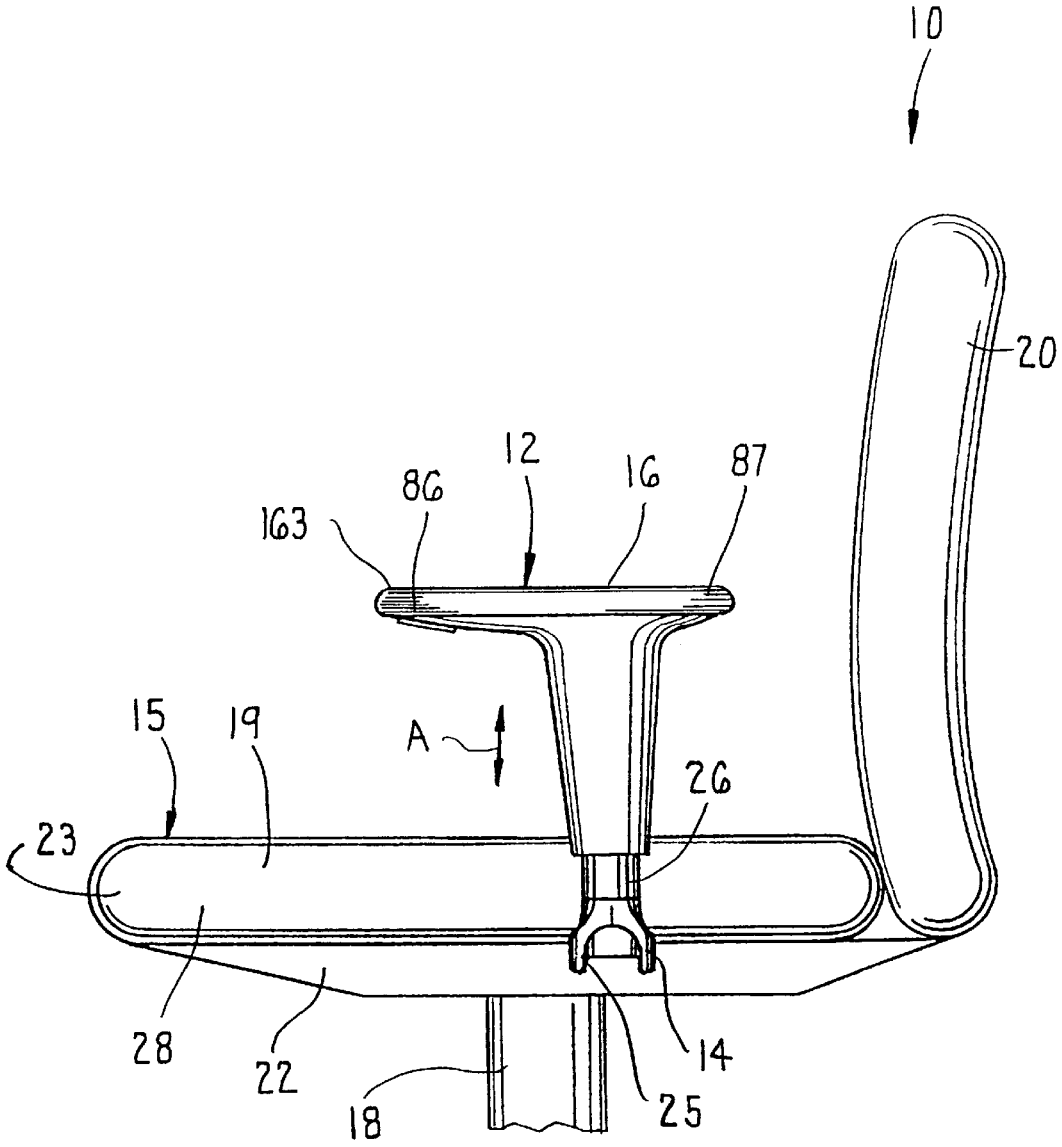
FIG. 1 is a side elevational view of an office chair having a first embodiment of an inventive chair arm mounted thereon.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the illustration and designated parts thereof. Said terminology will include the words specifically mentioned, derivatives thereof, and words of similar import.

DETAILED DESCRIPTION

Figure 2:
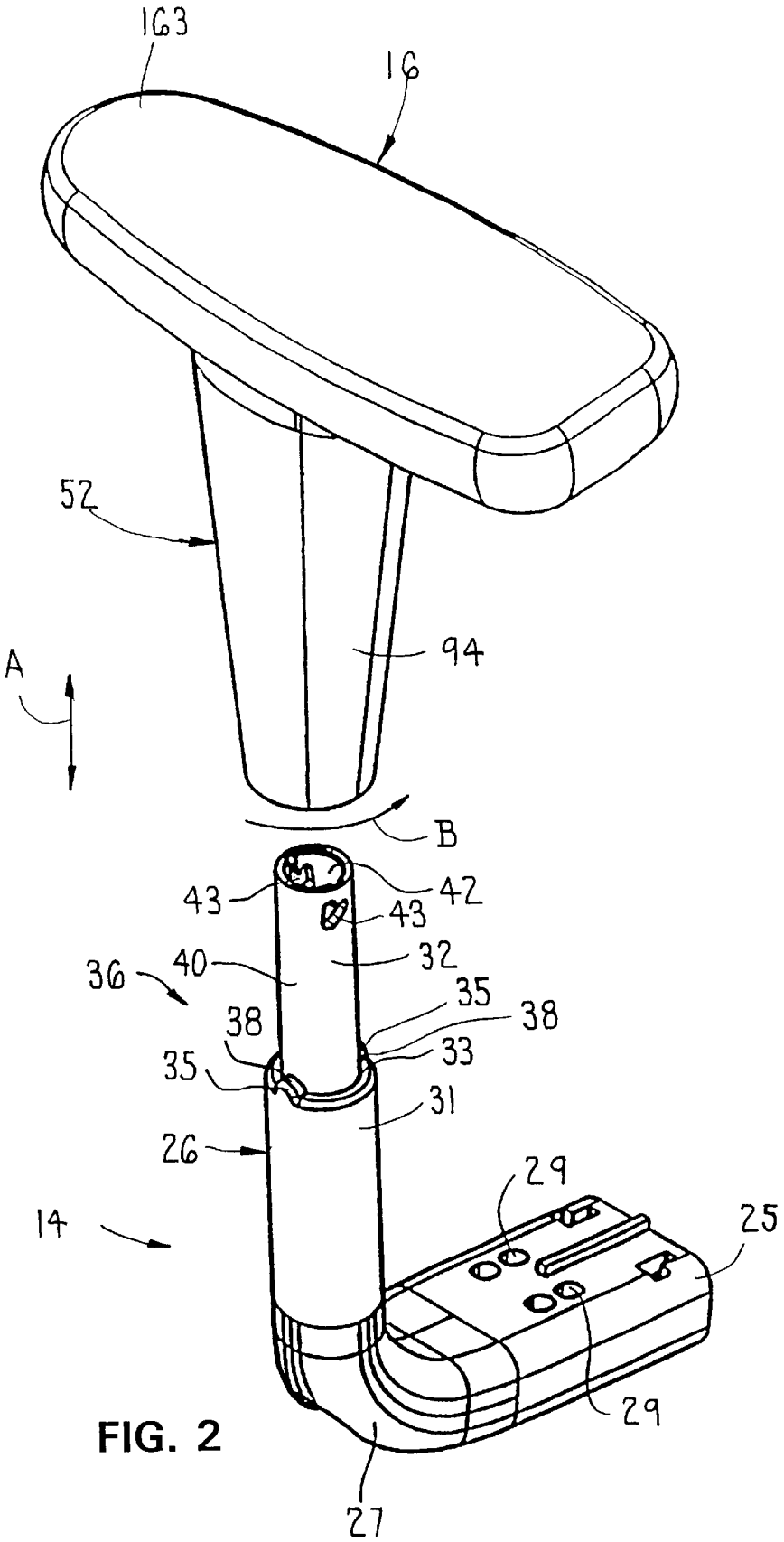
FIG. 2 is an exploded rear perspective view illustrating a support post and arm assembly of the chair arm.

Referring to FIGS. 1 and 2, a chair 10 is illustrated having a chair arm 12 of the invention mounted thereon. The chair arm 12 includes an upstanding support post or column 14 which extends upwardly from the chair 10 and supports an arm assembly 16 that is both rotatable and vertically movable as generally indicated by reference arrows A and B (FIG. 2) respectively.

The chair 10 may be of any conventional construction and preferably includes a pedestal 18 (FIG. 1) supported on a floor, and a seat-back assembly that includes a seat assembly 19 which is supported on an upper end of the pedestal 18 and a back assembly 20 which projects upwardly from a rear edge of the seat assembly 19. The seat assembly 19 includes a rigid seat housing 22 and a horizontally enlarged cushion 23 which overlies the seat housing 22.

A pair of the chair arms 12 is provided on the opposite sides of the seat assembly 19. Therefore, while only one chair arm 12 is illustrated in FIG. 1, it will be understood that a second chair arm 12 is mounted on the opposite side of the chair 10 wherein the support post 14 as illustrated in FIG. 2 is reversible and is mountable on either side of the seat assembly 19 without modifications thereto.

More particularly, the support post 14 is generally L-shaped so as to be defined by a substantially horizontal mounting bracket 25 and a substantially vertical upright leg 26 which is joined to the mounting bracket 25 by an elbow or corner section 27.

The mounting bracket 25 includes a plurality of fastener holes 29 by which the mounting bracket 25 is secured to an underside of the seat housing 22 by suitable fasteners. Accordingly, the upright leg 26 is disposed alongside an adjacent side edge 28 of the seat assembly 19 and projects upwardly above the cushion 23.

The upright leg 26 is defined by a cylindrical lower section 31 and a tubular sleeve mount 32 which extends coaxially from an upper end of the lower section 31. An upward facing shoulder 33 is defined at the junction between the lower section 31 and the upward projecting sleeve mount 32. The shoulder 33 is annular so as to extend about the circumference of the sleeve mount 32 and further includes a pair of detents 35 which define part of a detent arrangement 36 that acts between the arm assembly 16 and the support post 14. The detents 35 are disposed on opposite left and right sides of the shoulder 33 and project upwardly to each define an arcuate camming surface 38 thereon.

Figure 3:
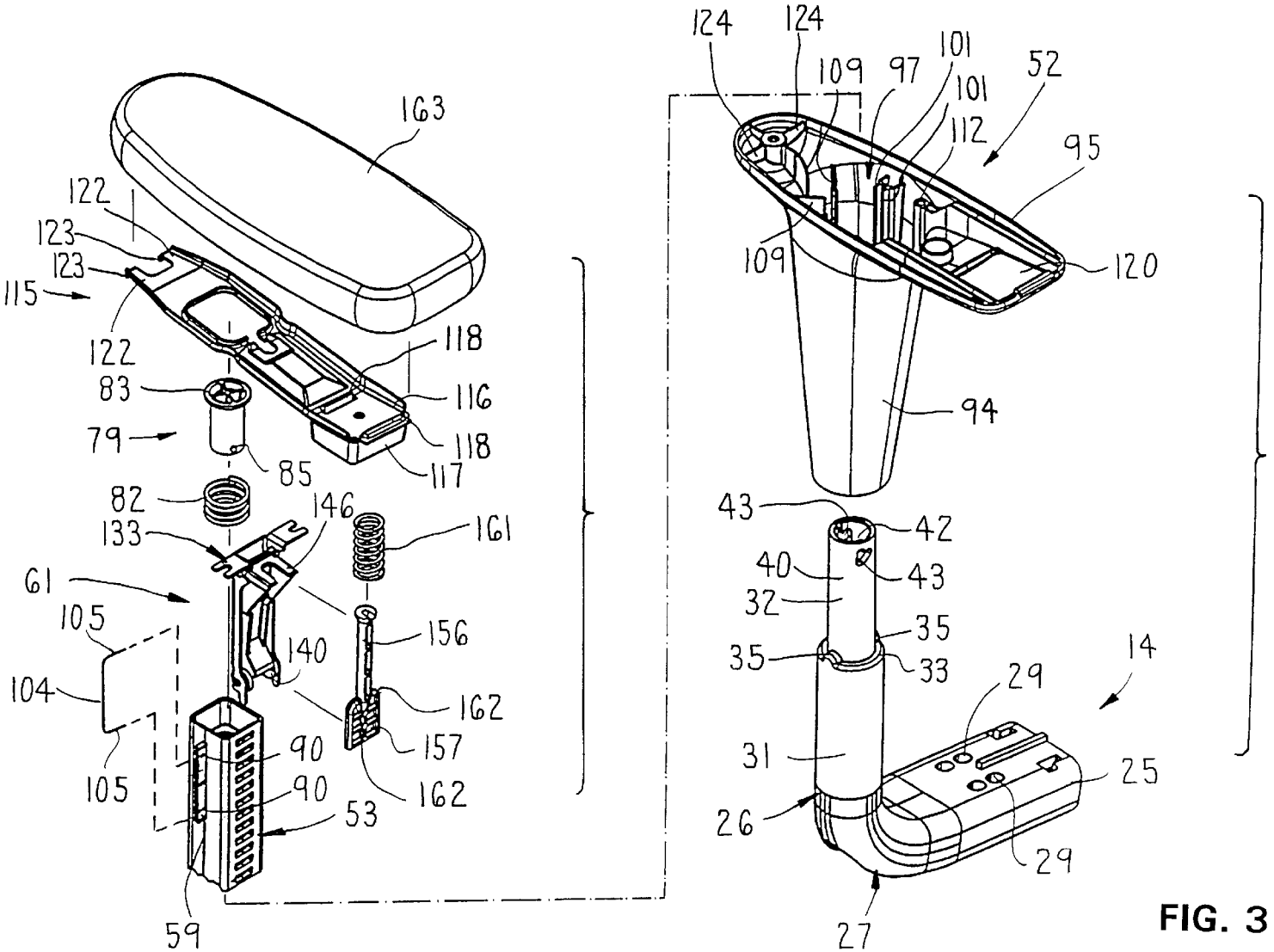
FIG. 3 is an exploded rear perspective view illustrating the internal components of the arm assembly.
Figure 6:
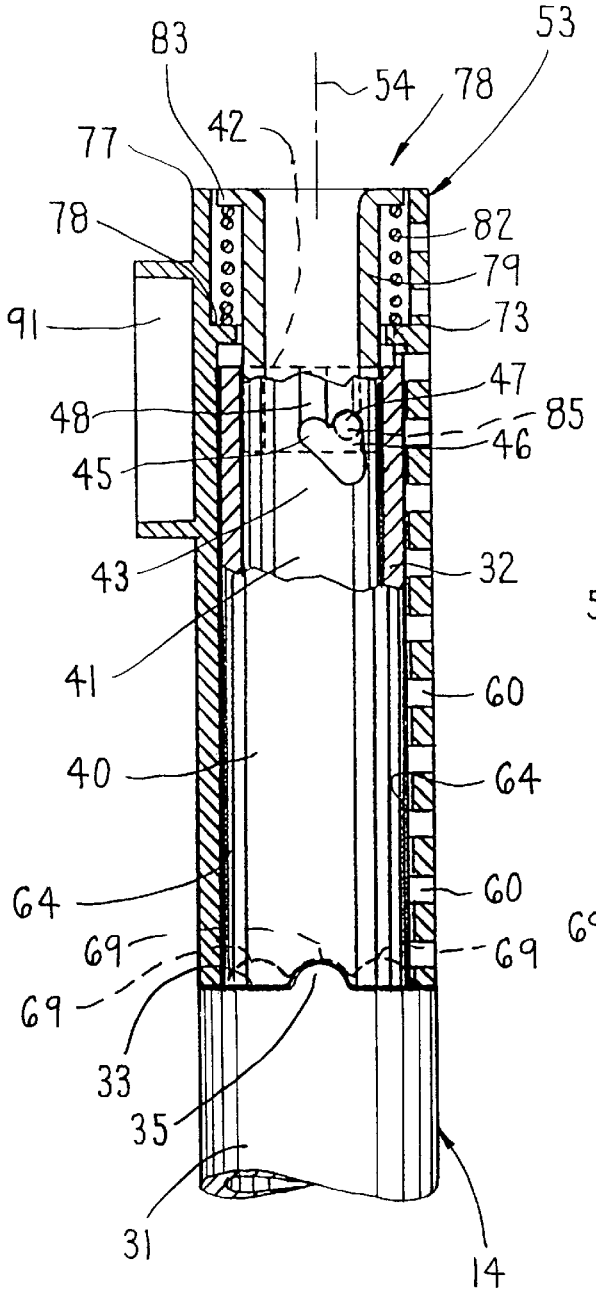
FIG. 6 is a side elevational view in cross-section illustrating the mounting of the sleeve to the support post as taken along line 6—6 of FIG. 5.

The sleeve mount 32 is a hollow cylindrical tube having a circumferential outer surface 40 and a hollow interior 41 which opens upwardly from an upper open end 42 thereof as illustrated in FIGS. 2, 3 and 6. The upper end of the sleeve mount 32 further includes a pair of pin openings 43 which open sidewardly through opposite sides of the outer wall thereof.

Referring to FIG. 6, the pin openings 43 generally have a V-shape defined by an entry leg 45 and a second leg 46 which defines a pin seat 47 at the upper end thereof. Additionally, the upper end of each entry leg 45 communicates with a vertical slot 48 which is formed in the interior surface of the sleeve mount 32 and opens vertically from the upper open end 42.

The arm assembly 16 further includes an arm housing 52 which is generally tubular so as to fit over the support post 14. Generally, the arm housing 52 includes a tubular sleeve 53 fixed therein wherein the tubular sleeve 53 is rotatably mounted to the sleeve mount 32 of the support post 14 to permit rotation of the arm housing 52 about a substantially vertical rotation axis 54 (FIG. 6). As described in further detail herein, the arm housing 52 also is vertically slidable along the sleeve 53 to permit adjustment of the height of the arm assembly 16.

Figure 4:
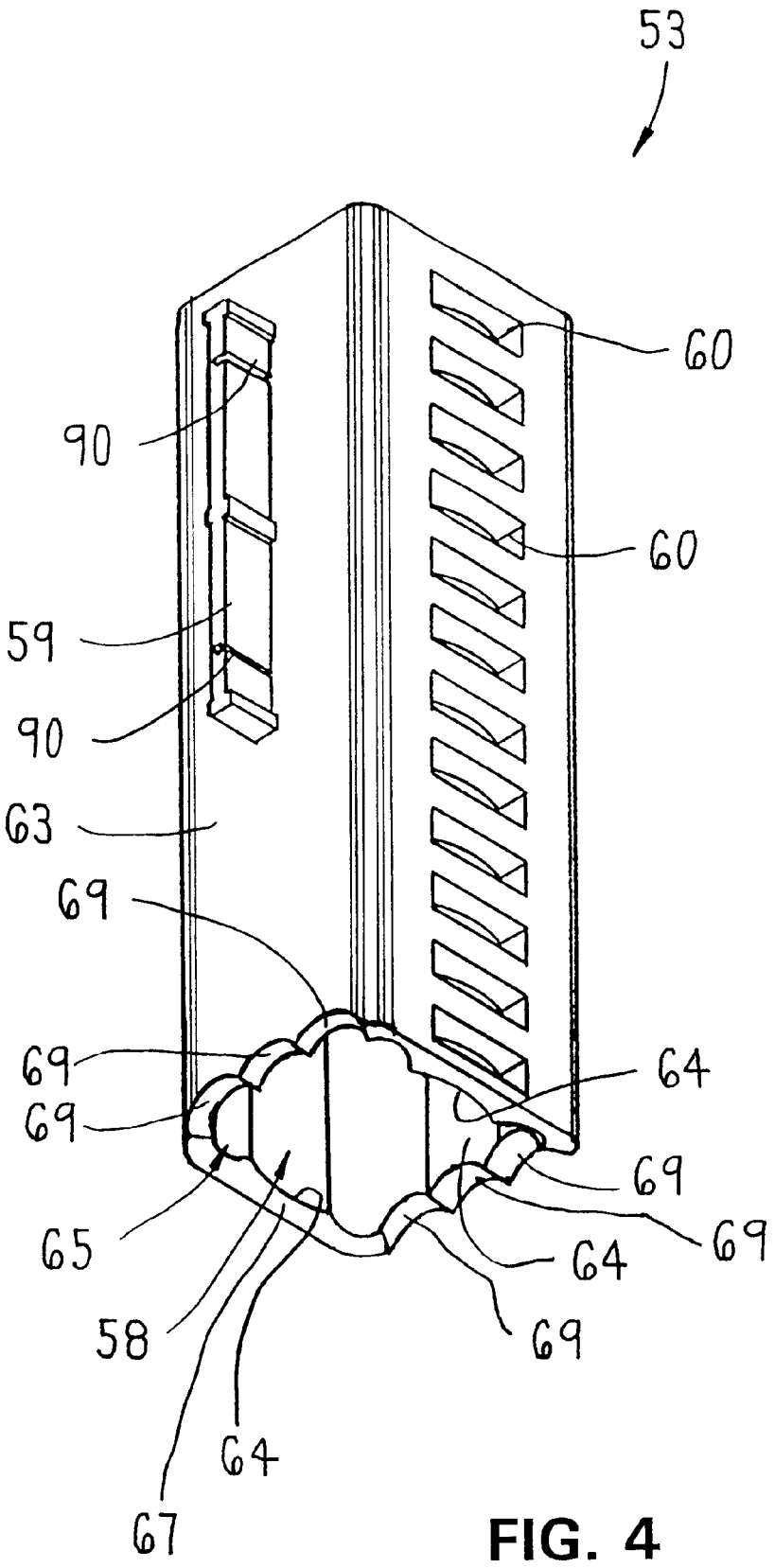
FIG. 4 is a bottom perspective view of a rotatable sleeve which mounts on the support post.

Referring more particularly to the sleeve 53 as illustrated in FIG. 4, the sleeve 53 includes: a hollow interior chamber 58 which allows the sleeve 53 to be slid downwardly onto the upper end of the sleeve mount 32; guide ribs 59 which secure the sleeve 53 within the hollow interior of the arm housing 52 but permit vertical sliding of the arm housing 52 relative thereto; and a plurality of vertically spaced apart notches 60 which are lockingly engaged by a lock mechanism 61 (FIG. 3) to lock the arm housing 52 at a selected elevation.

The sleeve 53 has four side walls which define a generally rectangular outer surface 63. The interior chamber 58, however, has arcuate surfaces 64 on the inside faces of the side walls which each have the same radius relative to the pivot axis 54 so as to define a substantially circular bore 65. The bore 65 has a diameter which is slightly larger than the outside diameter of the sleeve mount 32 so that the sleeve 53 is slidable downwardly onto the upper end of the sleeve mount 32 as illustrated in FIG. 6. Accordingly, the sleeve 53 is rotatable on the sleeve mount 32.

The sleeve 53 further includes a bottom edge 67 which faces downwardly and is vertically supported on the shoulder 33 of the support post 14. The bottom edge 67 further includes two sets of three arcuate notches 69 which notches 69 open downwardly and are adapted to receive a respective one of the upward-projecting detents 35 therein.

When each detent 35 is fitted into a respective one of the notches 69, the sleeve 53 is maintained in a predefined angular position. Since three notches 69 are provided, the center notch 69 defines a neutral position wherein the chair arm 12 extends parallel to the adjacent side edge 28 of the seat assembly 15. Since the sleeve 53 is rotatable, sleeve 53 can be rotated either clockwise or counterclockwise relative to the detent 35. After such rotation, each detent 35 is seated within either of the notches 69 located to the left or right of the center notch 69. When each detent 35 is seated within one of these side notches 69, the chair arm 12 is at an angular position which is angularly spaced 30 degrees from the neutral position.

Figure 5:
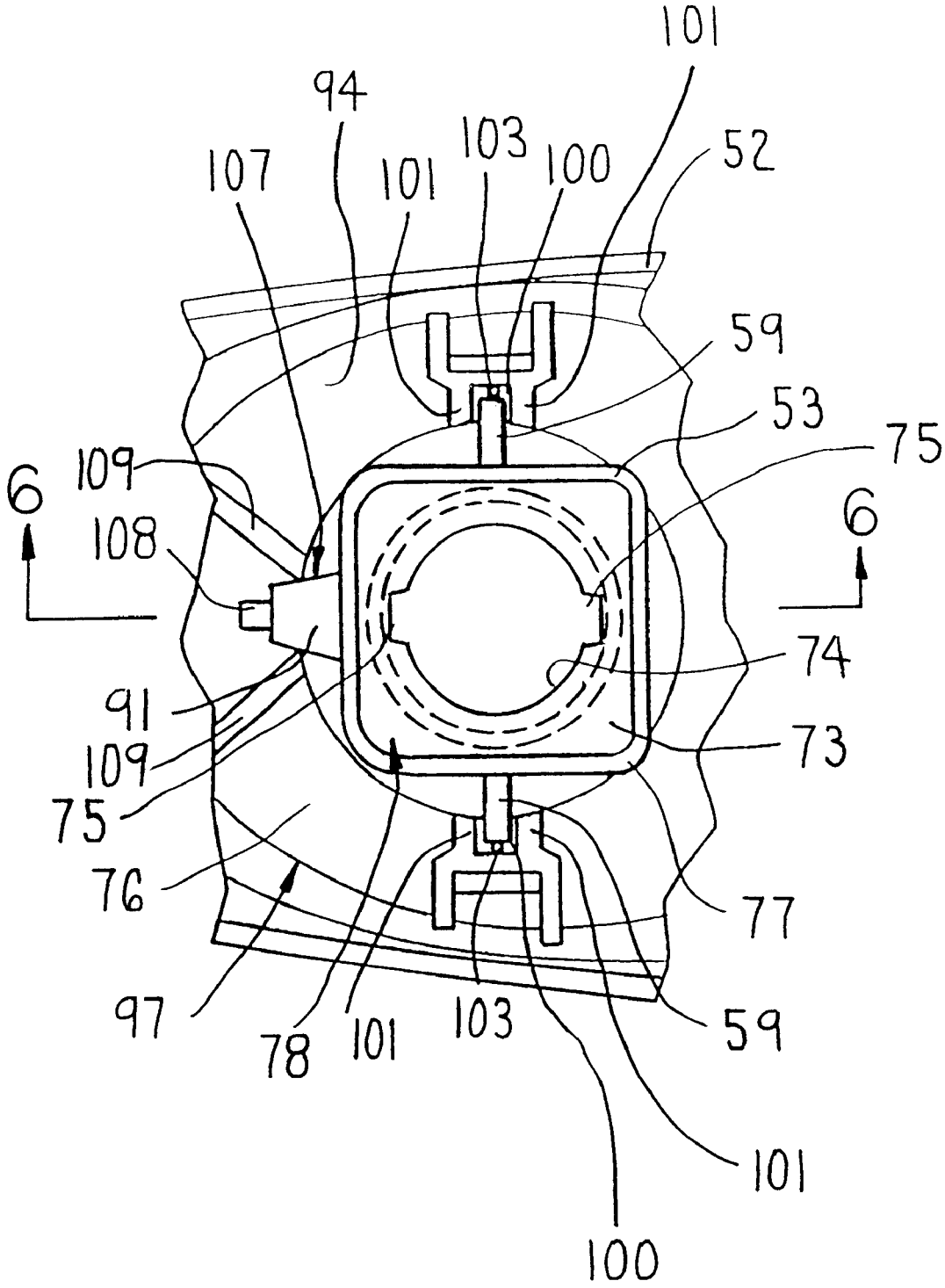
FIG. 5 is a partial top view of the sleeve mounted in an arm housing of the arm assembly.

To secure the sleeve 53 in place, the sleeve 53 also includes an annular wall 73 at the upper end thereof as seen in FIGS. 5 and 6. The wall 73 has a circular opening 74 and a pair of radial notches 75. Accordingly, an upward facing, generally annular abutment surface 76 is defined by the wall 73 which surface 76 is spaced downwardly from the upper edge 77 of the sleeve 53 to define an upward opening cavity or spring seat 78.

The sleeve 53 is fixedly secured to the upper end of the sleeve mount 32 by a cylindrical spring retainer or cap 79 and a coil spring 82. More particularly, the coil spring 82 (FIGS. 3 and 6) is inserted downwardly into the spring seat 78 and is supported on the abutment surface 76. The spring retainer 79 includes an annular lip 83 at the upper end thereof which confines the coil spring 82 vertically between the lip 83 and the opposing surface 76 of the wall 73. The spring retainer 79 further includes a pair of connector pins 85 which project radially outwardly from its outer circumferential surface to lock the retainer 79 on the upper end of the sleeve mount 32.

During assembly, the spring retainer 79 is manually inserted downwardly, whereby the connector pins 85 are able to slip downwardly through the radial notches 75 formed in the annular wall 73 and then enter the upper end of the vertical slots 48 defined in the sleeve mount 32. The spring retainer 79 is pressed further until the connector pins 85 enter the entry leg 45 of the pin openings 43, at which time the connector pins 85 slide along the inclined edge of the entry leg 45 and then the spring retainer 79 is rotated until the connector pins 85 are located below the pin seats 47. Once the spring retainer 79 is released, the coil spring 82 urges the spring retainer 79 upwardly until the connector pins 85 are seated or confined within the respective pin seats 47.

As a result, the coil spring 82 biases the spring retainer 79 and the sleeve 53 away from each other which not only prevents disengagement of the spring retainer 79 but also urges the sleeve 53 downwardly to ensure that each detent 35 is seated within a respective one of the notches 69.

Figure 7:
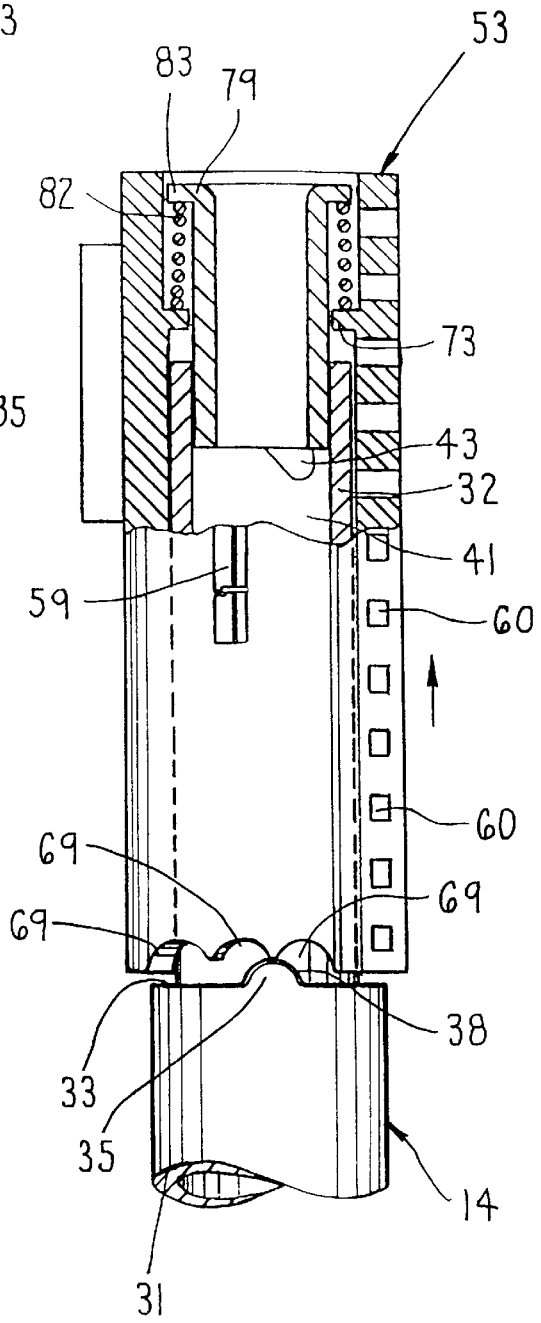
FIG. 7 is a side elevational view-illustrating the mounting arrangement of FIG. 6 with the sleeve disposed in a partially rotated position.

This arrangement, however, also permits rotation of the sleeve 53. In this regard, rotation of the sleeve 53 causes the notches 69 to ride up the arcuate surface 38 of the detent 35 which displaces the sleeve 35 upwardly as illustrated in FIG. 7. Upward displacement of the sleeve 53 is permitted since the coil spring 82 can be compressed. Thereafter, the coil spring 82 biases the sleeve 35 downwardly until the detents 35 are again seated within respective notches 69. This arrangement thereby permits rotation of the sleeve 53.

Further, the sleeve 53 can be rotated past the last notch 69 so that the arm assembly 16 can move angularly through 360 degrees. Since the chair arm 12 has a long end section 86 (FIG. 1) which typically projects forwardly and a short end section 87 which typically projects rearwardly, the rotation arrangement of the sleeve 53 permits the end sections 86 and 87 to be reversed, for example, such that the long end section 86 projects rearwardly.

With respect to the vertical sliding connection of the sleeve 53 and the arm housing 52, the connector ribs 59 are formed as vertically elongate projections having a pair of spring channels 90 in one side thereof. The spring channels 90 will be described in further detail hereinafter.

Additionally, a vertically elongate guide block 91 is provided in a rear wall thereof, the rear wall being defined as the wall which faces in the direction of the short end section 87. When viewed from above, the guide block 91 tapers rearwardly as illustrated in FIG. 5.

As for the vertical row of notches 60, these notches 60 are formed in the "front" wall of the sleeve 53 and are vertically spaced apart. Preferably, each notch 60 has a horizontally elongate rectangular shape as illustrated in FIG. 4.

Turning to the arm housing 52, the arm housing 52 includes an upright tubular support column 94, and a horizontally elongate armrest 95 disposed on an upper end of the support column 94. The support column 94 and armrest 95 are molded integrally together as a single monolithic piece of a polymer material or other suitable material.

The column 94 has a bottom opening 96 and an interior cavity 97 which extends vertically therethrough whereby the column 94 is telescopingly connected to the sleeve 53 which sleeve 53 is disposed within the interior cavity 97 proximate the bottom opening 96. Thereafter, the column 94 is slide downwardly in telescoping engagement with the support post 14 by sliding of the sleeve 53 on to the sleeve mount 32. As discussed in further detail herein, the sleeve 53 thereby serves as an intermediate member which defines a first rotatable connection with the support post 14 and a second vertically slidable or telescoping connection with the arm housing 52.

Figure 9:
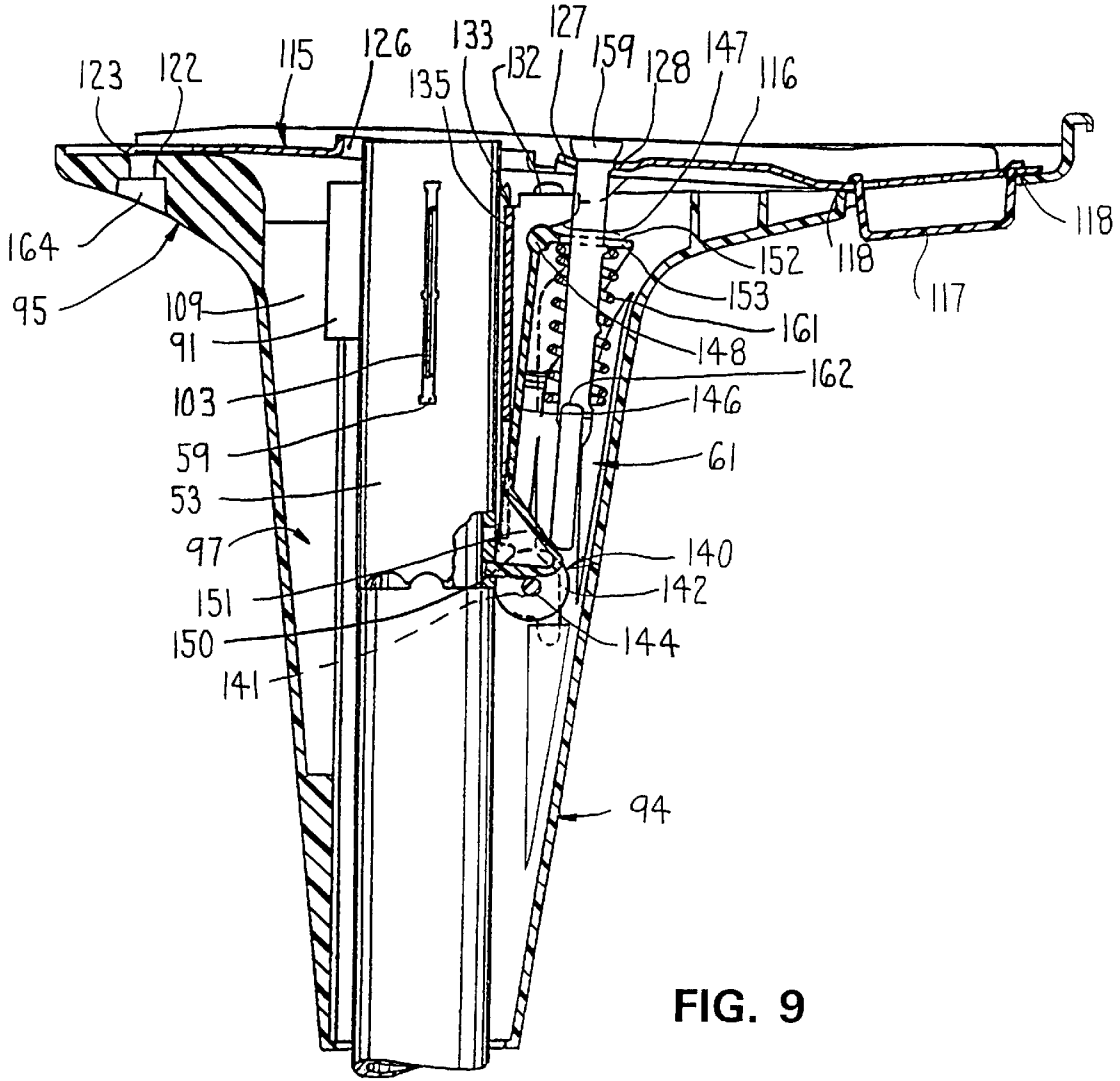
FIG. 9 is a side cross-sectional view of the chair arm as taken along line 9—9 of FIG. 8.

More particularly as seen in FIG. 9, the column 94 has a generally conical shape which flares upwardly outwardly away from the bottom opening 96 so that the upper end of the cavity 97 is radially enlarged relative to the bottom opening 96 both for aesthetics and to accommodate the lock mechanism 61 within the interior cavity 97.

Figure 8:
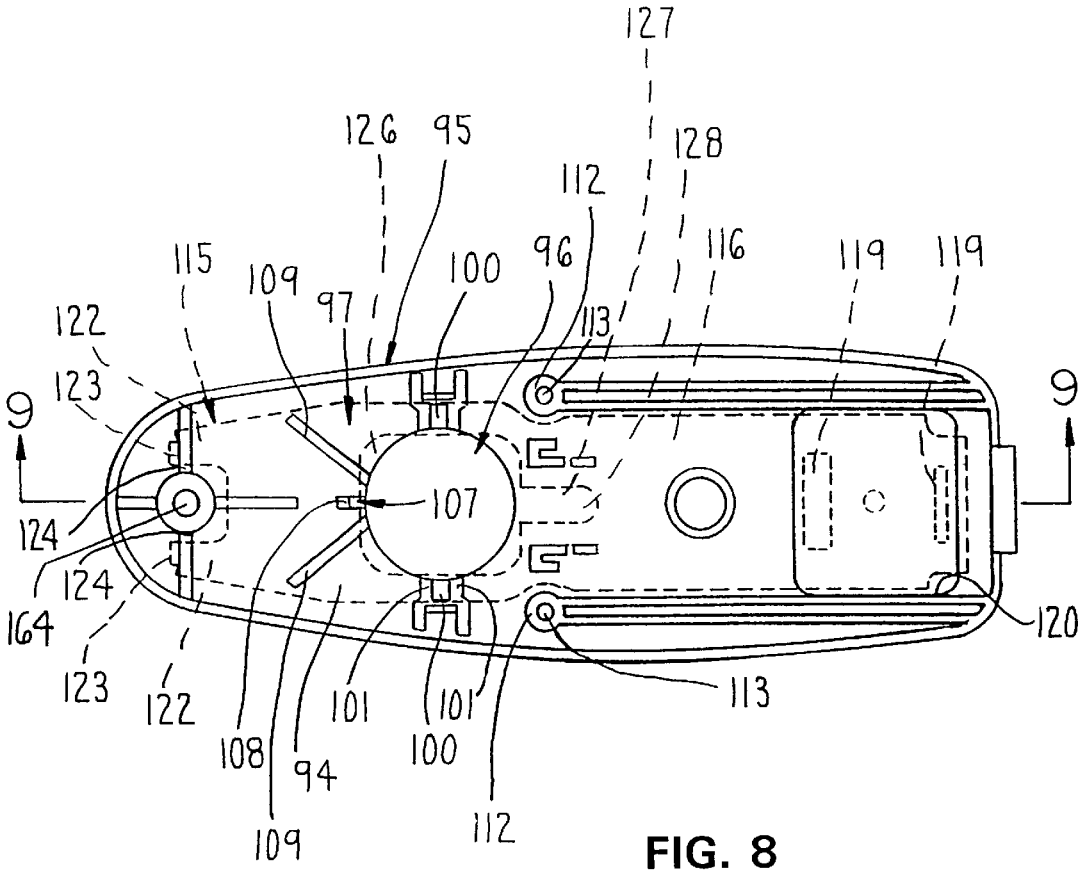
FIG. 8 is a top plan view of the arm housing having an actuator lever illustrated in phantom outline.

To slidably secure the column 94 to the sleeve 53, the column 94 is molded with a pair of vertically elongate guide slots 100 as illustrated in FIGS. 5 and 8. The guide slots 100 are defined by parallel ribs 101 which project radially inwardly from the inside surface of the column 94. Each slot 100 is defined between a respective pair of ribs 101 and thereby opens radially inwardly and vertically upwardly.

Referring to FIG. 5, connection of the arm housing 52 and the sleeve 53 is accomplished by sliding the arm housing 52 onto the upper end of the support post 14 and then inserting the sleeve 53 downwardly into the interior cavity 97 of the column 94 wherein the vertically elongate connector ribs 59 of the sleeve 53 are slid downwardly into the open upper ends of the vertical guide slots 100. Once the sleeve 53 is secured to the sleeve mount 32 as discussed above, the arm housing 52 is slidable upwardly and downwardly relative to the sleeve 53 in telescoping engagement and thereby is vertically movable relative to the support post 14.

To accommodate tolerances sidewardly between the guide slots 100 and the connector ribs 59 and provide a tight fit, each connector rib 59 includes a generally U-shaped spring wire 103 which presses outwardly against the opposing inside surface of the respective guide slot 100 as seen in FIGS. 5 and 9. Referring to FIG. 3, the spring wire 103 includes an arcuate biasing or spring section 104 and a pair of connector legs 105 at the opposite ends of the biasing section 104. The connector legs 105 are inserted into the spring channels 90 so that the arcuate spring section 104 projects outwardly of and is vertically aligned with the respective guide rib 59 as can be seen in FIG. 9.

To further guide the sleeve 53 within the interior cavity 97, the inside surface of the column 94 on a back side thereof includes a vertically elongate rear guide slot 107 (FIG. 5) which opens forwardly and receives the guide block 91 of the sleeve 53 therein. The rear guide slot 107 is defined by a center rib 108 which projects radially inwardly in a forward direction, and a pair of side ribs 109 which project radially inwardly at an angle relative to the center rib 108. The terminal edges of the ribs 108 and 109 define the rear guide slot 107 along which the guide block 91 can slide.

To support the lock mechanism 61 on the arm housing 52, the armrest 95 further includes a pair of connector posts 112 (FIGS. 3, 8 and 9) which are disposed forwardly of the lower opening 96. Each connector post 112 includes an upward opening fastener bore 113.

Furthermore, to manually actuate the lock mechanism 61, the arm assembly 16 also includes an actuator lever 115, which is illustrated in solid outline in FIGS. 3 and 9 and phantom outline in FIG. 8. The actuator lever 115 includes a stamped metal lever arm 116 which is horizontally elongate and has a downwardly projecting button 117 at the front end thereof. The button 117 is secured to the front end of the lever arm 116 by a pair of outwardly projecting flanges 118 which snap lockingly engage a pair of elongate slots 119 (FIG. 8) disposed in the front lever end. The button 117 projects downwardly through a square opening 120 formed in the front end of the armrest 95 (FIGS. 3 and 8) so as to be accessible from an exterior of the armrest 95.

To pivotally support the lever arm 116 on the armrest 95, the rear end of the upper arm 116 includes a pair of sidewardly spaced apart arm extensions 122 which each include a downwardly projecting hook-like pivot flange 123 at the rear terminal edge thereof as illustrated in FIGS. 3 and 8. The arm extensions 122 and pivot flanges 123 effectively hook over an upper edge of a pair of support ribs 124 in the armrest 95. The cooperation of the pivot flanges 123 and the upper edges of the support ribs 124 define a horizontal pivot axis about which the lever arm 116 can pivot upwardly.

The lever arm 116 receives the upper end of the sleeve 53 through a generally rectangular central opening 126 as seen in FIG. 9. The front end of the pivot opening 126 also includes a forwardly extending slot 127 which defines a plunger seat 128 at the front terminal and thereof.

Figure 11:
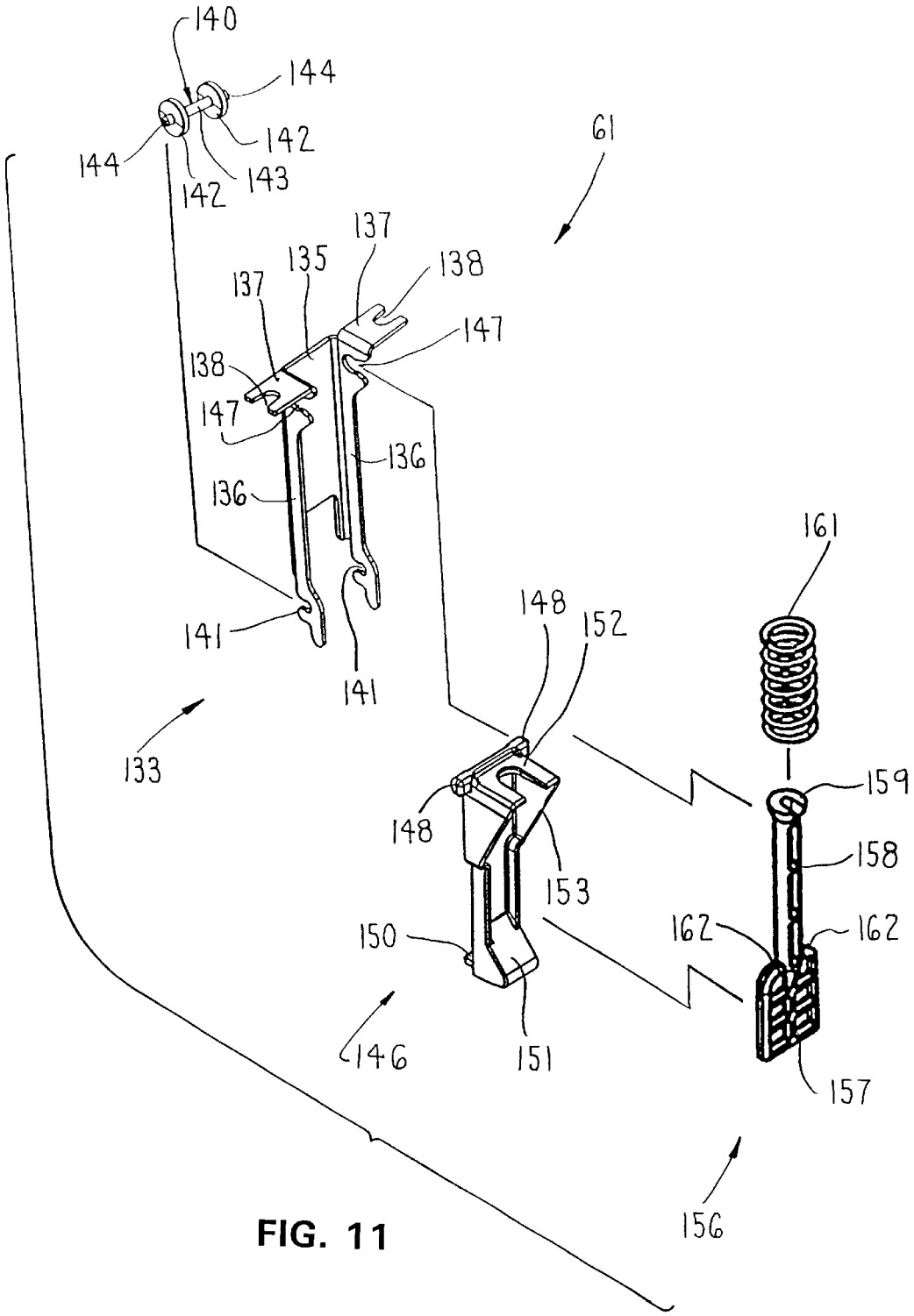
FIG. 11 is an exploded perspective view of the lock mechanism.

Turning to the lock mechanism 61, the lock mechanism 61 is formed as a cartridge assembly which is mounted to the posts 112 of the armrest 95 by fasteners 132 (FIG. 9). Referring more particularly to FIGS. 9 and 11, the lock mechanism 61 includes a rigid carrier 133 which is defined by a vertical back wall 135, a pair of side walls 136 and a pair of support flanges 137 which project from the upper ends of the side walls 136.

Each support flange 137 includes a notch 138 which is adapted to overlie the fastener bores 113 of the posts 112. When the lock mechanism 61 is inserted downwardly into the interior cavity 97 of the arm housing 52, the support flanges 137 are disposed on the top surfaces of the respective support posts 112 wherein the fastener 132 is threaded downwardly to secure the carrier 133 on the armrest 95. As such, the carrier 133 is suspended within the cavity 97.

To prevent tilting of the arm housing 52 relative to the sleeve 53, the lower end of the carrier 133 rotatably supports a wheel unit 140 thereon. Specifically, each side wall 136 includes a rearward opening pivot notch 141 whereby the pivot notches 141 secure the wheel unit 140 to the carrier 133. The wheel unit 140 includes a pair of circular wheels 142 joined together by an axle 143 whereby the opposite ends of the wheel axle 143 project outwardly from the wheels 142 to define pivot pins 144 which snap into the notches 141 and permit rotation of the wheel unit 140. The wheels 142 roll along the outer surface of the sleeve 53 to maintain the arm housing 52 and sleeve 53 in alignment and reduce friction.

To lock the arm housing 52 in place, a lock lever 146 has an upper end which is connected to pivot notches 147 formed in the side walls 136. In particular, the lock lever 146 includes a pair of pivot pins 148 which project sidewardly therefrom and snap into the open ends of the pivot notches 147. Accordingly, the lock lever 146 is supported on the carrier 143 and is pivotable about a horizontal pivot axis.

The lower end of the lock lever 146 includes a rigid projection or lock member 150 which projects toward the sleeve 53 and engages any one of the notches 60 which may be aligned therewith. To engage and disengage the projection 150 with the notches 60, the lock lever 146 further includes wedge-shaped inclined surface or ramp 151 which faces upwardly and outwardly away from the sleeve 53. The upper end of the lock lever 146 also includes an upper wall 152 which is spaced upwardly above the ramp 151 and includes a generally horizontal slot 153 having an open front end.

The lock mechanism 61 has a vertical plunger 156 which projects downwardly onto the ramp 151 to urge the lock lever 146 in a clockwise direction toward the sleeve 53 and cause insertion of the projection 150 into a respective one of the notches 60.

More particularly, the plunger 156 includes an enlarged blade 157 at the bottom thereof which blade 157 acts downwardly on the ramp 151. A plunger shaft 158 projects upwardly from the plate 157 through the slot 153 defined in the upper wall 152 of the lock lever 146 and thereafter vertically through the slot 127 formed in the actuator lever 115. The upper terminal end of the plunger shaft 158 has an enlarged annular rim 159 which abuts downwardly against the plunger seat 128 such that the plunger 156 is suspended from the actuator lever 115. As such, pressing of the actuator button 117 upwardly causes the actuator lever 115 to pivot and raise the plunger blade 157 away from the ramp 151.

A coil spring 161 is positioned vertically between the upward facing shoulders 162 on the blade 57 and the downward facing surface of the upper wall 152 of the lock lever 146. The coil spring 161 is in compression so as to bias the plunger 156 downwardly yet also bias the upper wall 152 upwardly. Although the downward biasing of the plunger 156 urges the lock lever 146 in a clockwise direction and the upward biasing of the upper lever wall 152 urges the lock lever 146 in the opposite counter clockwise direction, the clockwise torque created by the plunger 156 is greater than the opposing counter clockwise torque at the upper lever wall 152. Accordingly, in this condition, the plunger 156 is driven downwardly and due to the incline of the ramp 151 causes insertion of the projection 150 sidewardly into a respective one of the notches 60.

When the plunger 156 is engaged with the lock lever 146, the force of the compression spring 161 acting on the plunger 156 wedges the lock lever 146 against the rotating sleeve 53. The rotating sleeve 53 is thereby forced into contact with an inside face of the arm housing 52. This wedging action assists in reducing if not eliminating free-play in the arm assembly 16.

Figure 10:
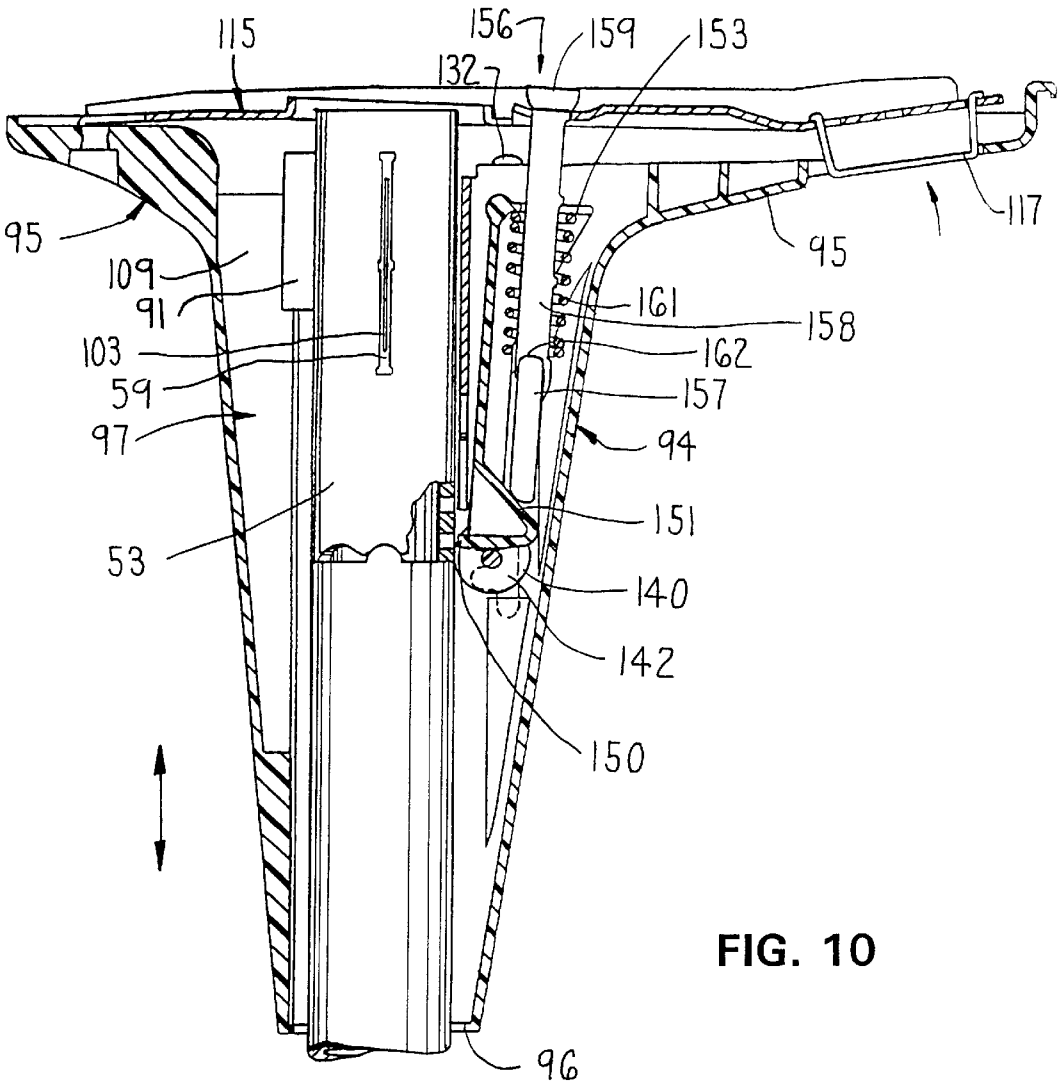
FIG. 10 is a side cross-sectional view of the chair arm with a lock mechanism thereof in a disengaged condition.

In the engaged condition, the arm housing 52 is maintained at a selected elevation. To adjust the height of the arm housing 52, however, the button 117 is pressed upwardly as illustrated in FIG. 10. Pivoting of the actuator lever 115 thereby increases the upward force acting on the upper lever wall 152 to cause the lock lever 146 to pivot away from the notches 60 of the sleeve 53. This thereby removes the lock projection 150 from the notches 60 and permits the chair occupant to manually raise or lower the arm housing 52 to a desired height.

Downward movement of the arm housing 52 is stopped at a lower limit of travel by the bottom surface of the lock lever 122 which contacts the upper surface 91*a* (FIG. 10) of the guide block 91. Conversely, upward movement of the arm housing 52 is stopped at an upper limit thereof by an upward facing shoulder 52*a* of the arm housing 52 which contacts the bottom surface 91*b* of the guide block 91.

Finally, the arm assembly 16 includes a horizontally enlarged top cap 163 which is connected to the armrest 95 to enclose the hollow interior thereof. Specifically, the top cap 163 is hooked onto the front end of the armrest 95 and then the rear end thereof is swung downwardly. The rear end of the arm cap 163 secured in place by a fastener which is threaded upwardly through a fastener bore 164 (FIGS. 8 and 9) which is disposed adjacent the ribs 124. The top cap 163 is formed of suitable resilient material to support the arms of an occupant.

In operation, therefore, the arm assembly 16 can be independently rotated or adjusted vertically relative to the support posts 14. In this regard, the sleeve 53 is secured within the arm housing 52 in vertically slidable relation.

With the top cap 163 removed, the arm housing 52 is first slid downwardly onto the support post 14, and then the sleeve 53 is slid into the hollow interior of the arm housing 52 and then fitted onto the sleeve mount 32. The sleeve is fixedly secured to the sleeve mount 32 by engagement of the spring retainer 79 therewith wherein the spring retainer 79 is inserted downwardly and then rotated to a locked position. The lock mechanism 61 also is secured in place and then the arm cap 163 is secured in place to enclose the armrest 95.

Once installed, the arm assembly 16 can either be rotated and/or vertically moved to a position and orientation which is most comfortable to the chair occupant. With respect to the rotational orientation of the arm assembly 16, the arm assemblies 16 typically are positioned parallel to the opposite side edges 28 of the seat assembly 15 wherein the detents 35 are engaged with the center notches 69. However, the occupant merely needs to grip and rotate each arm assembly 16 to a new position wherein rotation thereof causes the sleeve 53 to slide upwardly up over the detents 35 which vertical movement of the sleeve 53 is permitted by the engagement of the spring retainer 79 and the respective coil spring 82. The end detents 69 define additional angular positions which are spaced 30 degrees away from the center position. As an additional advantage, the spring loading on the detents also assists in reducing if not eliminating free-play in the arm assembly 16.

Also, the arm assembly 16 can be rotated 360 degrees. In particular, in the conventional position illustrated in FIG. 1, the long section 86 of the armrest 95 projects forwardly while the short section 87 projects rearwardly. It may be desirable to reverse the positions of the long and short sections 86 and 87 which is permitted since the sleeve 53 can rotate 360 degrees about the pivot axis 54. By reversing the positions of the arm assemblies 16, this may provide a more comfortable position for the user depending upon the task being performed and also may permit the chair 10 to be pushed closer to a work surface, desk or the like.

The arm assembly 16 also is adjustable vertically. Adjustment is accomplished when the occupant presses the button 117 upwardly which moves the plunger 156 away from the ramp 151 on the lock lever 146. This causes the coil spring 161 to urge the lock lever 146 upwardly which thereby causes pivoting of the lock lever 146 away from the sleeve 53 and disengagement of the lock projection 150 from the respective notch 60. The occupant then raises or lowers the arm housing 53 to a desired elevation. When the button 117 is released, the coil spring 161 biases the plunger 156 downwardly against the ramp 151 and rotates the lock lever 146 toward the sleeve 53.

With this arrangement, the sleeve 53 thereby defines an intermediate member which is rotatably engaged to the support post 14 for rotation of the arm assembly 16 and is vertically slidably engaged with the arm housing 52. As a result, this intermediate member, i.e. the sleeve 53 thereby forms part of a rotation connection and a vertical slide connection. This arrangement is believed to be an improvement over those known rotatable, height-adjustable chair arm structures.

A further variation of this invention is illustrated in FIGS. 12–19. Specifically, this modified embodiment includes a modified arrangement for the chair arm of the invention. Those components illustrated in these drawings which correspond to components already described above are designated herein with the same reference numeral having the additional suffix "–1". Additionally, the chair arm arrangement of FIGS. 12–19 illustrates a unique connection arrangement for pivotally connecting the chair arm 12-1 to a seat assembly 15-1 which connection permits pivoting of the entire chair arm 12-1 relative thereto in addition to the rotation of the arm assembly 16-1 relative to the support post 14-1.

More particularly as to the modifications to the chair arm 12-1 as compared to the chair arm 12 discussed previously, the chair arm 12-1 of the second embodiment is connected to a seat assembly 19-1 of the chair 10-1. The seat assembly 19-1 includes a seat housing 22-1 (FIG. 12) and a cushion 23-1 supported on an upper surface thereof.

The chair arm 12-1 includes the support post 14-1 having a mounting bracket 25-1 which is rigidly connected to the seat housing 22-1. The support post 14-1 includes an upright leg 26-1 having a lower section 31-1 and the sleeve mount 32-1 which are formed substantially the same as the lower section 31 and sleeve mount 32 discussed above, at least as to the connection of the arm housing 52-1 thereto.

More specifically, the sleeve mount 32-1 is adapted to rotatably support a sleeve 53-1 (FIG. 14) in substantially the same way as the sleeve 53 is supported on the above-described sleeve mount 32. The primary difference being that the detent arrangement 36-1 differs from the detent arrangement 36. In this regard, the shoulder 33-1 does not have upwardly projecting detents 35 but instead includes a pair of notches 200 which open radially and upwardly through the surface of the shoulder 33-1 on radially opposite sides of the lower section 31-1. Furthermore, the bottom edge of the sleeve 53-1 also does not include the notches 60 thereon although it also is possible to use the identical sleeve 53 with the modified detent arrangement 36-1.

Figure 14:
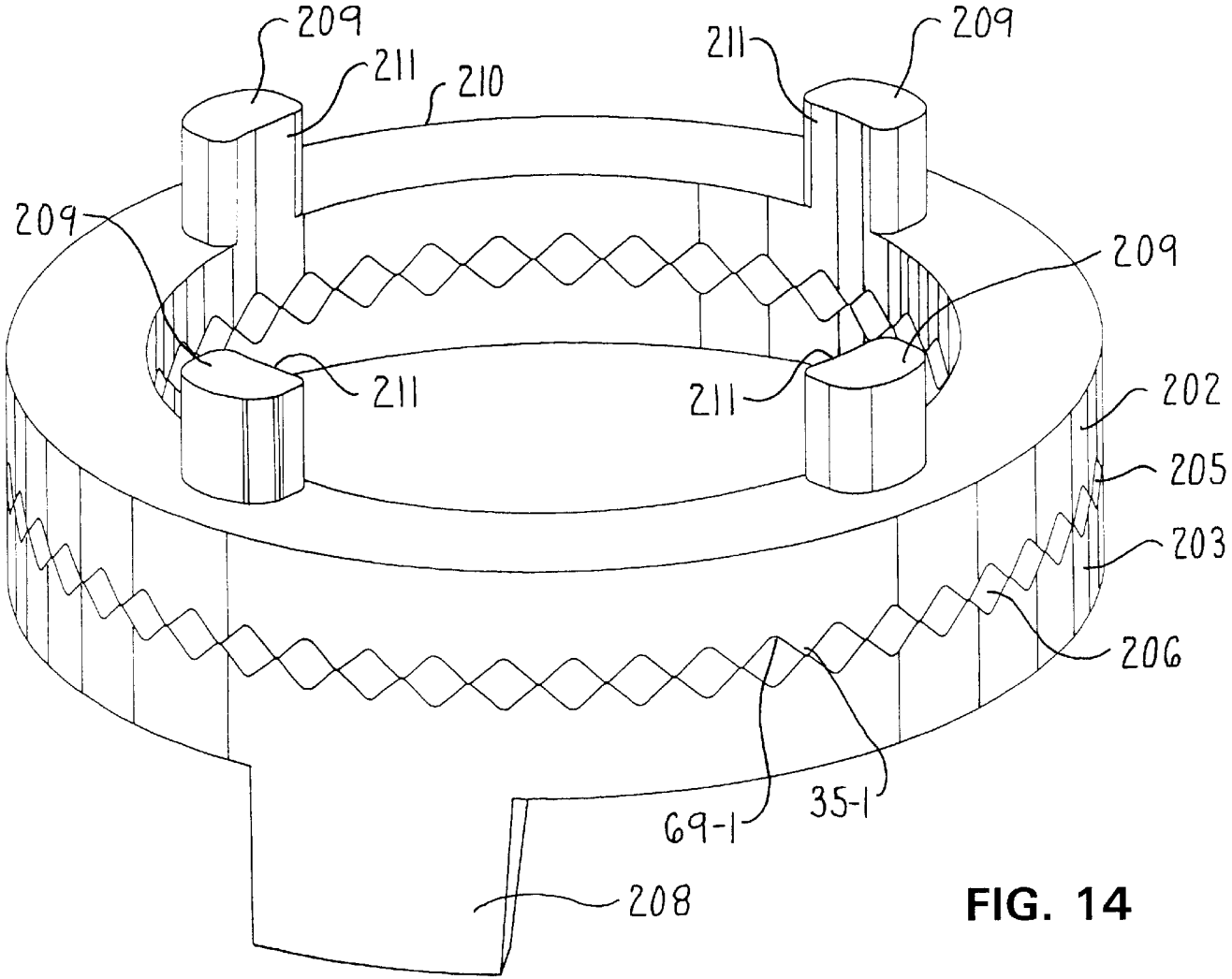
FIG. 14 is an enlarged front perspective view of the detent arrangement.

With respect to the detent arrangement 36-1, this arrangement is defined by a pair of detent rings 202 and 203 that have opposing surfaces which matingly engaged together to perform the detent function. In particular, each of the detent rings 202 and 203 includes an annular row of teeth 205 and 206 which respectively project downwardly and upwardly and extend about the annular surfaces of the rings 202 and 203. The teeth 205 and 206 effectively define detents 35-1 with the grooves therebetween defining notches 69-1 as generally indicated in FIG. 14.

To secure the detent arrangement in place, the lower ring 203 includes a pair of downwardly projecting blocks 208 whereby the lower ring 203 is slid downwardly onto the sleeve mount 32-1. The blocks 208 are seated within the corresponding notches 200 in frictional engagement therewith whereby the lower ring 203 is supported on the shoulder 33-1. The respective ring of teeth 206 thereby faces upwardly.

Figures 15, 16:
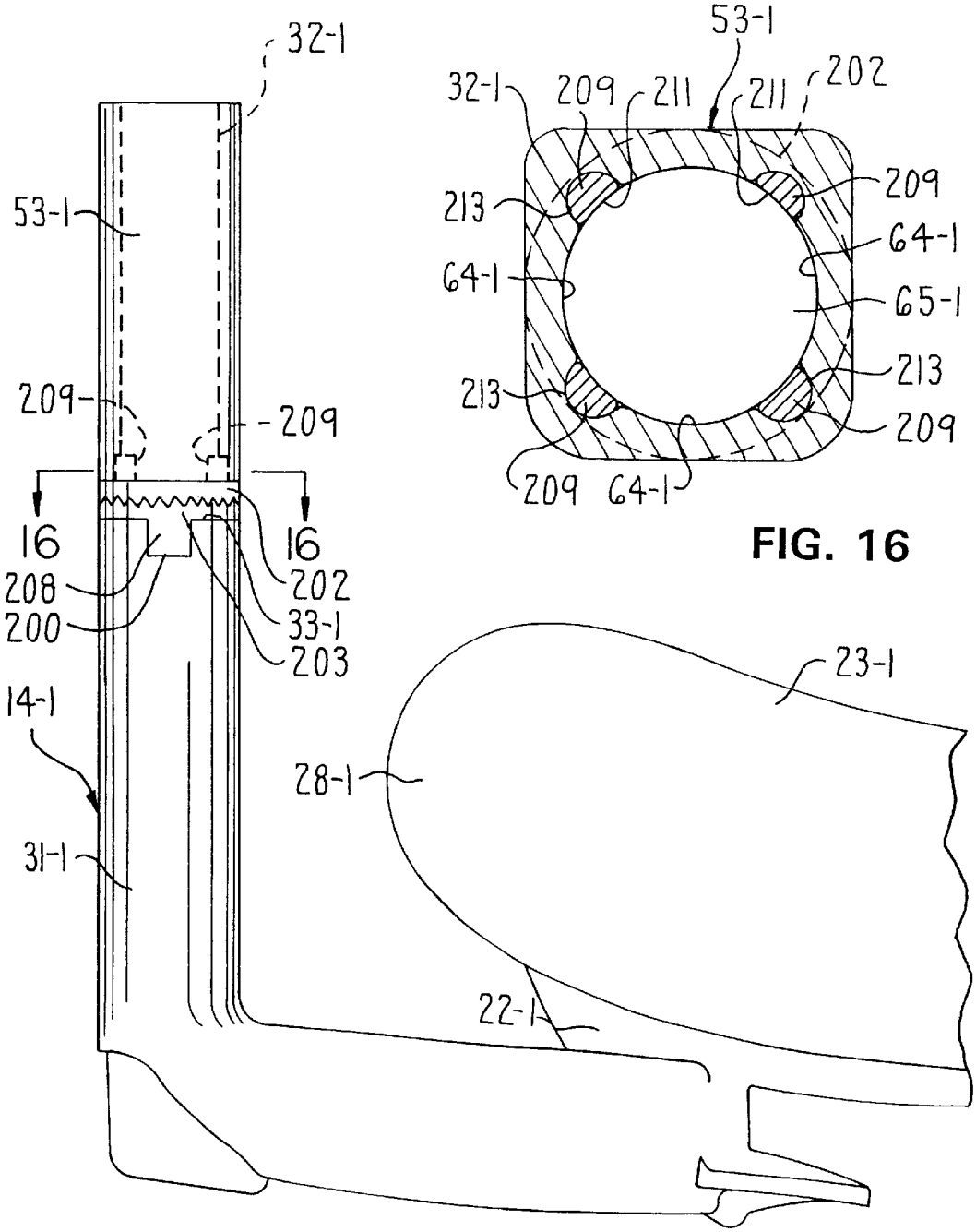
FIG. 15 is a front elevational view of the chair illustrating a sleeve and support post rotatably joined together with the detent arrangement disposed therebetween.
FIG. 16 is a top cross-sectional view of the sleeve and detent arrangement joined together as taken along line 16—16 of FIG. 15.

With respect to the upper ring 202, a plurality and preferably four posts 209 and are provided on the upper surface 210. Each post 209 is generally cylindrical except that an inside arcuate surface 211 is provided. The upper detent ring 202 is fitted into the lower end of the sleeve 53-1 as generally illustrated in FIGS. 15 and 16. Referring to FIG. 16, the sleeve 53-1 includes a circular bore 65-1 therein that is defined by a plurality and preferably four arcuate surfaces 64-1. Additionally, reliefs 213 are formed proximate the quarters of the sleeve 53-1. The cross-sectional shape of the sleeve 53-1 is identical to the sleeve 53 discussed above whereby the reliefs 213 are formed during molding of the sleeves 53 or 53-1. The posts 209 fit into the respective reliefs 213 whereby the arcuate surfaces 211 are flush with the arcuate surfaces 64-1 of the central bore 65-1.

As a result, the respective teeth 205 and 206 of the detent rings 202 and 203 matingly engage together when the sleeve 53-1 is secured on the sleeve mount 32-1. Further discussion of the engagement of the sleeve 53-1 to the sleeve mount 32-1 or the cooperation of the arm housing 52-1 with the sleeve 53-1 is not required since the structural and functional operation of these parts is the same as that discussed above with respect to the first embodiment.

Since the sleeve 53-1, like the sleeve 53, is vertically shiftable relative to the support post 14-1 during rotation thereof, the respective teeth 205 and 206 are able to slide upwardly relative to each other to permit rotation of the arm assembly 16-1 while maintaining the arm assembly 16-1 in a plurality of discrete angularly spaced apart positions. The teeth 205 and 206 are formed so that each vertically adjacent pair of cooperating teeth 205 and 206 is in line contact across the entire radial width of the teeth 205 and 206. Further, the teeth 205 and 206 define discrete stop positions at 10 degree intervals through which the arm assembly 16-1 can rotate during complete rotation of the arm assembly 16-1 through 360 degrees.

With this modified arrangement, the upper and lower detent rings 202 and 203 respectively can be readily replaced, for example, upon wear of the teeth although wear is minimized by the line contact between opposing pairs of teeth. Also, it may be desirable when the chair arm is used on multiple chair models, to provide detent rings 202 and 203 having different angular intervals besides the 10 degree intervals provided by the illustrated embodiment. Additionally, the identical sleeve 53 can also be provided with the upper and lower detent rings 202 and 203 without making modifications thereto. Therefore the same sleeve 53 can be used on both the support post 14-1 when detent rings 202 and 203 are needed to provide detent positions extending through 360 degrees, and on the support post 14 when no detent rings are needed and only two sets of detents are desired.

The modified arrangement also is particularly suitable when the support post 14-1 is used. This support post 14-1 as discussed in greater detail hereinafter has a mounting bracket arrangement which permits pivoting of the entire chair arm 12-1 relative to the seat assembly 19-1 as generally indicated by reference arrow A in FIG. 12. As the chair arm 12-1 is pivoted either inwardly or outwardly, it is desirable to rotate the arm assembly 16-1 inwardly or outwardly as indicated by reference arrow B to correct the angular displacement of the chair arm 12-1 whereby the arm assembly 16-1 remains substantially parallel to the adjacent side edge 28-1 of the seat assembly 19-1. The modified chair arm 12-1 is particularly suitable since the 10 degree increments of rotation provide for precise angular positioning of the arm assembly 16-1.

With respect to the mounting bracket arrangement, the seat housing 22-1 includes a rigid steel plate 215 extending laterally across the bottom surface thereof. The mounting bracket 25-1 has a generally triangular shape with a pivot connection being defined near one apex thereof by a pivot bolt 216 which is pivotally secured to the steel plate 215. This permits pivoting of the entire mounting bracket 25-1 about the pivot axis which extends vertically through the pivot bolt 216.

The mounting bracket 25-1 also includes the support post 14-1 at a second apex thereof which support post 14-1 projects upwardly therefrom. As such, the support post 14-1 moves outwardly and inwardly in a sideward direction toward and away from the seat assembly 19-1 during pivoting of the mounting bracket 25-1.

To limit rotation and also permit locking, a second lock bolt 218 is provided wherein the head 219 of the lock bolt 218 cooperates with an actuator level 221 to selectively prevent and permit pivoting of the chair arm 12-1. An upper end of the lock bolt 218 is threadedly engaged with a boss 222 of the seat support 22-1. The upper end of the lock bolt 218 in particular extends through the boss 222 and is engaged to a connector washer 223 which connector washer 223 is anchored to an upper end of the boss 222.

The mounting bracket 25-1 also includes a sidewardly elongate arcuate slot 226 and receives the lock bolt 218 vertically therethrough. The head 219 of the lock bolt 218 includes an enlarged washer 227 which presses upwardly on the mounting bracket 25-1 to provide further vertical support to the chair arm 12-1. More particularly, the mounting bracket 25-1 includes an upper plate 228 and any interior support plate 229 which abut vertically against each other. Threading of the lock bolt 218 upwardly thereby presses the washer 227 against the bottom surface of the support plate 229 so that the upper plate 228 and support plate 229 are confined between the boss 222 and the washer 227.

The lock bolt 218 also includes a biasing arrangement defined by a washer 231 and a spring washer 232 which are compressed between the boss 222 and the upper surface of the upper plate 228. While the lock bolt 218 is sufficiently loose to permit pivoting of the mounting bracket 25-1 about the pivot bolt 216 whereby the lock bolt 218 slides horizontally along the arcuate slot 226, the opposing washer 231 and spring washer 232 provide frictional resistance to this pivoting.

The upper plate 228 may be formed of a rigid metal material which provides significant rigidity between the top plate 228 and the lower post section 31-1 such that the support plate 229 is not required. However, the mounting bracket 25-1 also may be formed of a less rigid material such as plastic such that the support plate 229 is provided to strengthen the mounting bracket 25-1.

Specifically, the support plate 229 is formed of a rigid material and has a horizontal section 233 and a vertical section 234 which extends upwardly into a cavity 235 defined within the lower post section 31-1. The inside face of the vertical section 234 abuts against the opposing inside surface of the cavity 235 to significantly limit flexing or distortion of the mounting bracket 25-1.

Figure 12:
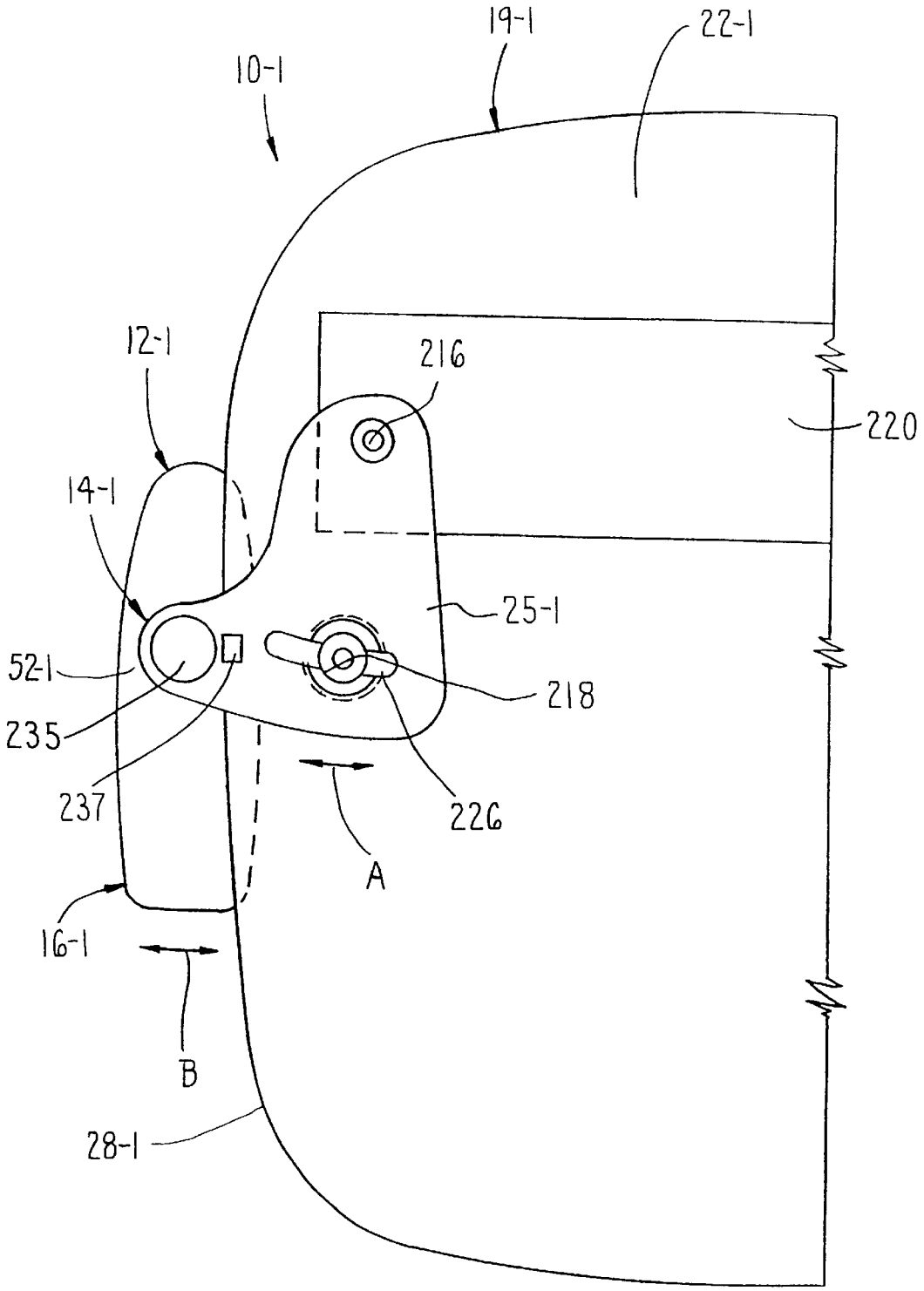
FIG. 12 is a bottom view of a second embodiment of the chair arm of the invention.
Figure 13:
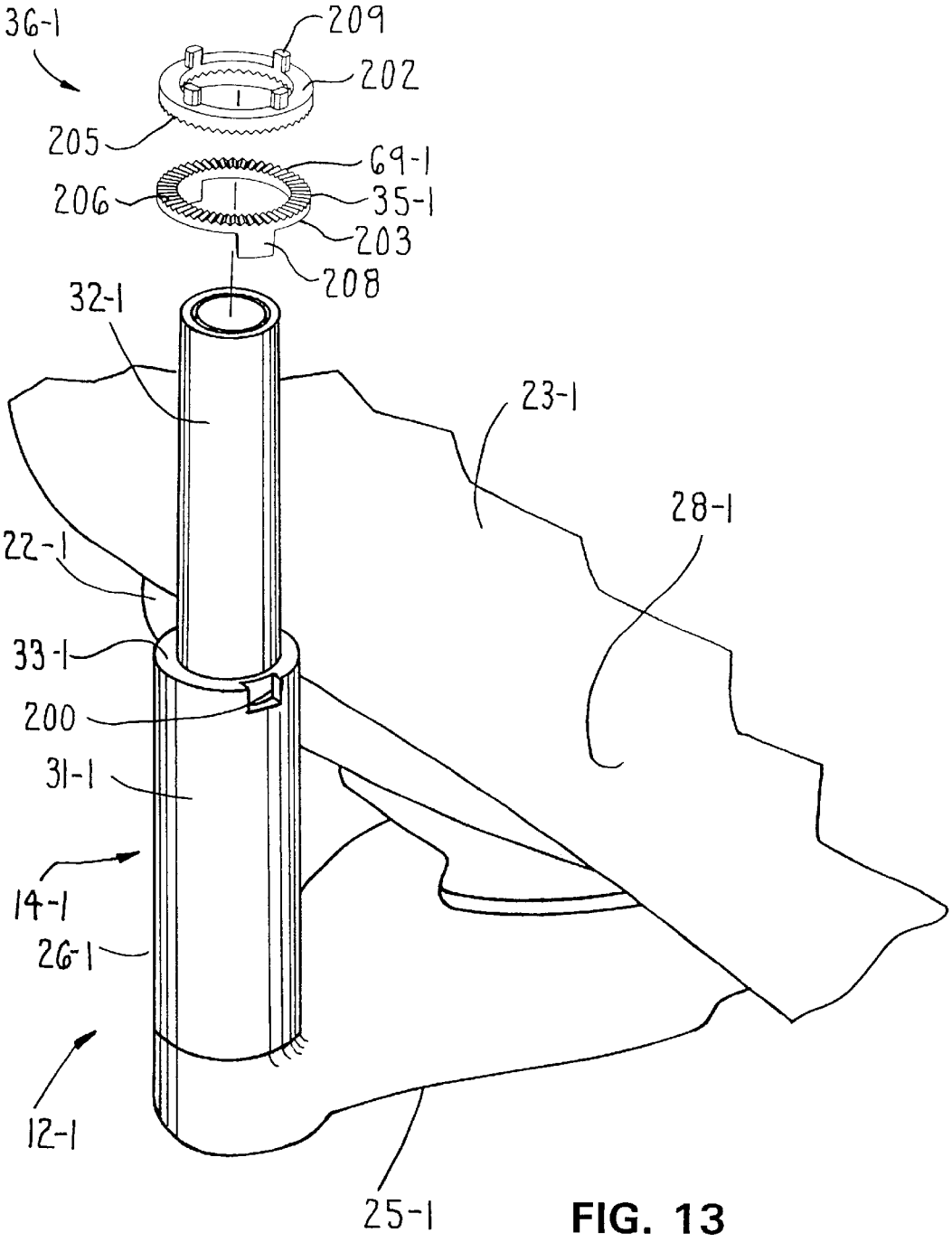
FIG. 13 is an exploded front perspective view of a support post and detent arrangement to the second embodiment.

The upper plate 228 also includes a downwardly projecting pivot mount 237 which has a pin-receiving bore 238 opening horizontally therethrough. The pivot mount 237 is provided to pivotally support the actuator lever 221 as described in further detail herein. The position of the pivot mount 237 is also illustrated in FIG. 12 wherein the actuator lever 221 is not illustrated therein for clarity. The upper end of the vertical section 234 also is generally U-shaped to define a downwardly projecting spring flange 240.

Figure 17:
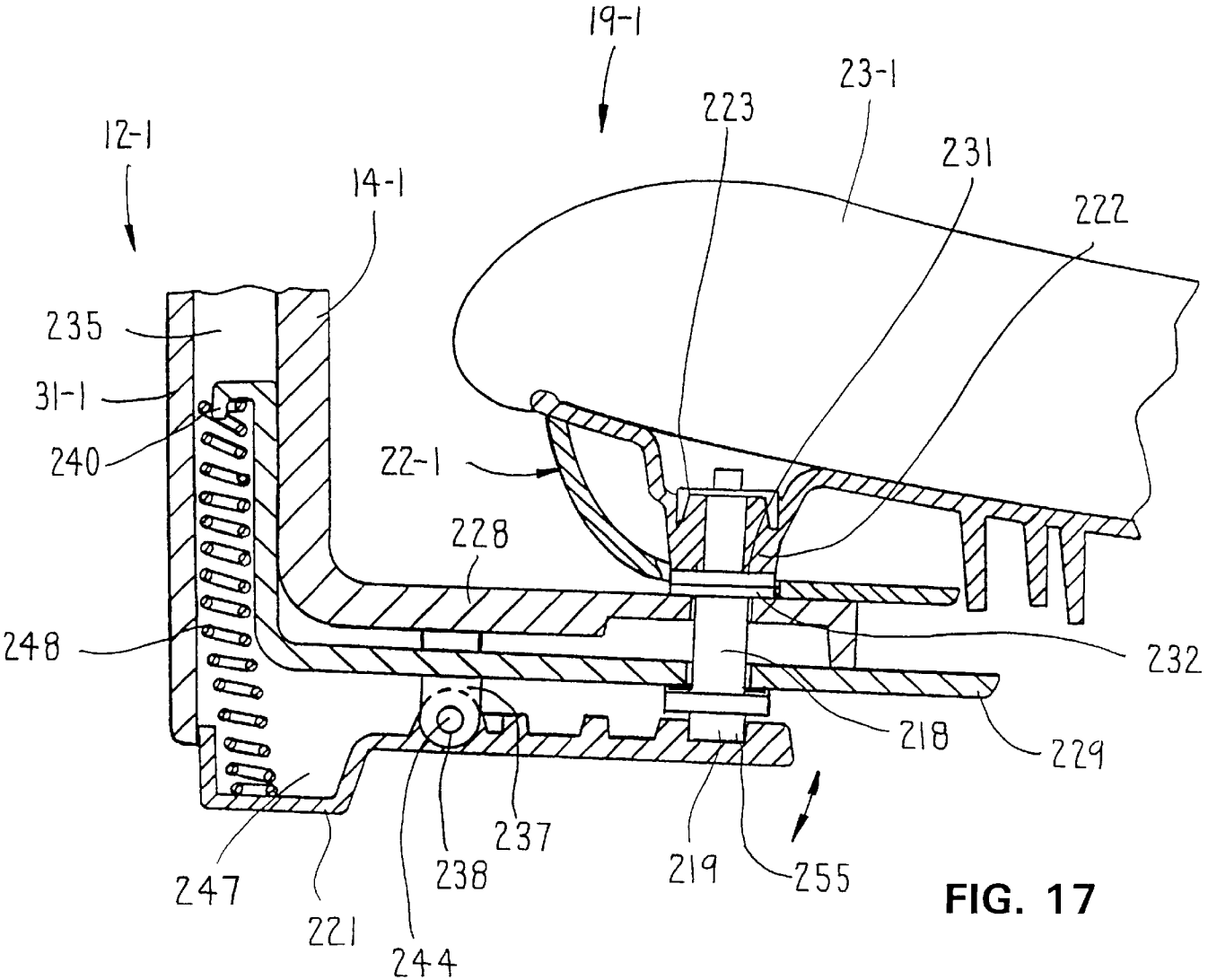
FIG. 17 is a front elevational view in cross-section of the connection of the support post to a seat assembly of the chair.
Figure 18:
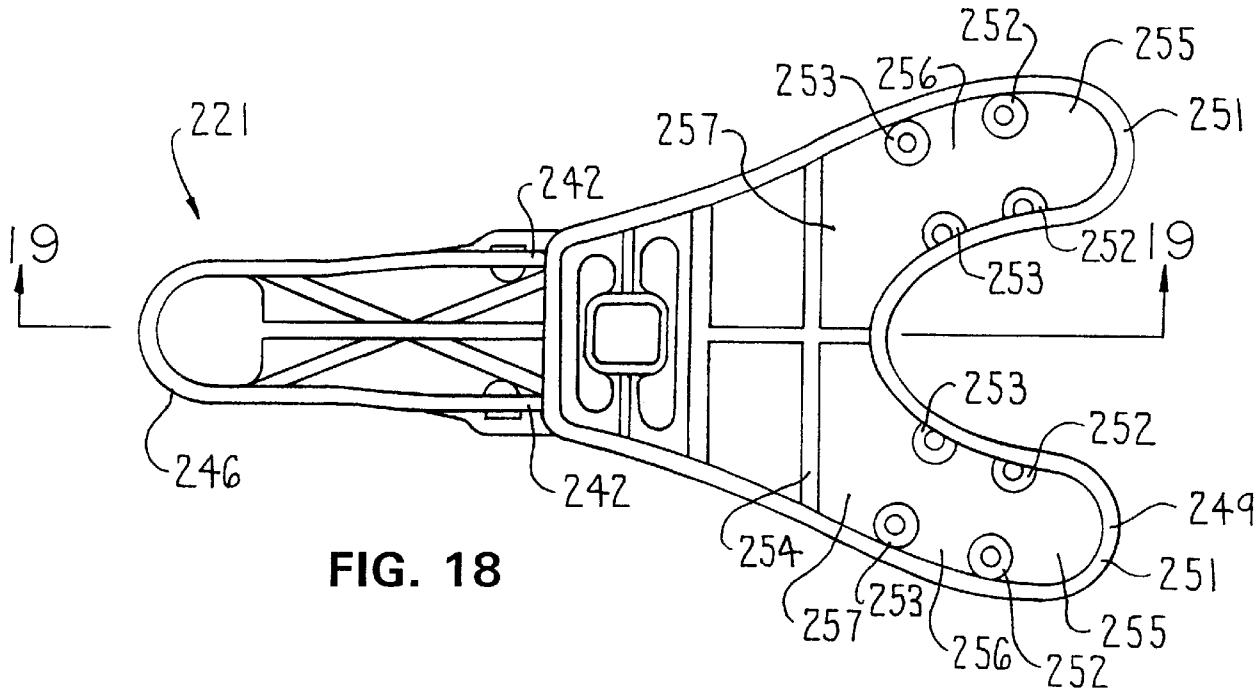
FIG. 18 is a plan view of an actuator lever.
Figure 19:
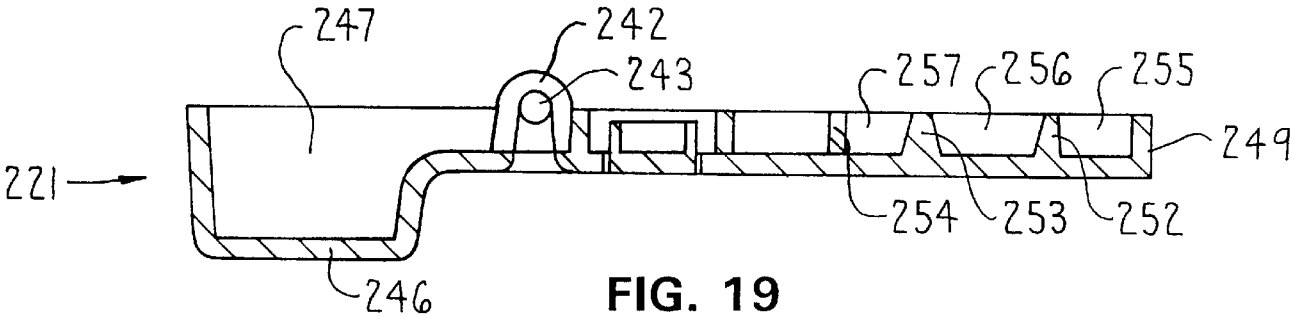
FIG. 19 is a front view in cross-section of the actuator lever as taken along line 19—19 of FIG. 18.

Which respect to the actuator lever 221 as illustrated in FIGS. 17, 18 and 19, the actuator lever 221 is horizontally elongate and includes a pair of upwardly projecting pivot flanges 242 which each include a bore 243 projecting horizontally therethrough. The actuator lever 221 is pivotally connected to the pivot mount 237 by a horizontal pivot pin 244 (FIG. 16).

The outer distal end of the actuator lever 221 includes a downwardly projecting button 246 which button defines a spring seat 247. A spring 248 extends vertically between the spring seat 247 and the spring flange 240 whereby the spring 248 is in compression to bias the button 246 downwardly. A chair occupant, however, can manually press the button 246 upwardly, which causes pivoting of the inner distal end 249 away from the bolt head 219.

More particularly, the inner distal end 249 is forked so as to define a pair of identical connector legs 251. The connector legs 251 have an arc which is substantially the same as the arc of the slot 226 such that one of the legs 251 generally extends along and below the slot 226 so as to be operative. The second leg 251 is inoperative but becomes operative when an identical actuator arm 221 is used in the second chair arm 12-1 on the opposite side of the seat assembly 19-1.

Each connector leg 251 includes two pairs of inner and outer posts 252 and 253 which pairs are sidewardly spaced apart. Further, a downwardly projecting interior rib 254 is provided outwardly of the outer posts 253. The posts 252 and 253 and the rib 254 thereby are spaced apart to define first, second and third lock cavities 255, 256 and 257 respectively which cavities open upwardly and are adapted to receive the head 219 of the lock bolt 218 therein.

Referring to FIG. 16, when the arm assembly 12-1 is pivoted outwardly to its farthest position, the lock bolt 218 is slid to the inner end of the slot 226 such that the head 219 is seated within the lock cavity 255. To pivot the chair arm 12-1 inwardly, the button 221 is pressed upwardly which thereby pivots the inner distal end 249 and disengages the bolt head 219 from the cavity 255. Accordingly, pivoting of the chair arm 12-1 about pivot bolt 216 is permitted. Upon inward pivoting, the bolt head 219 can then be confined within either the center cavity 256 or the outer end cavity 257 such that the cavities 255, 256 and 257 define three angularly spaced apart pivot positions for the chair arm 12-1. Once the chair arm 12-1 is pivoted to a desired position which causes inward movement of the arm assembly 16-1, it typically is desirable to then rotate the arm assembly 16-1 so that it is returned to an orientation which is generally parallel to the side edges of the seat assembly 19-1.

This pivot arrangement for the chair arm 12-1 provides a unique arm arrangement that is provided in combination with the rotatable and height-adjustable arm assembly 16-1 to provide a chair arm 12-1 having a high degree of adjustability. It will be understood that the pivot arrangement illustrated in FIGS. 11 and 16 can also be provided separate from the rotatable and height-adjustable chair arm structure.

Figure 20:
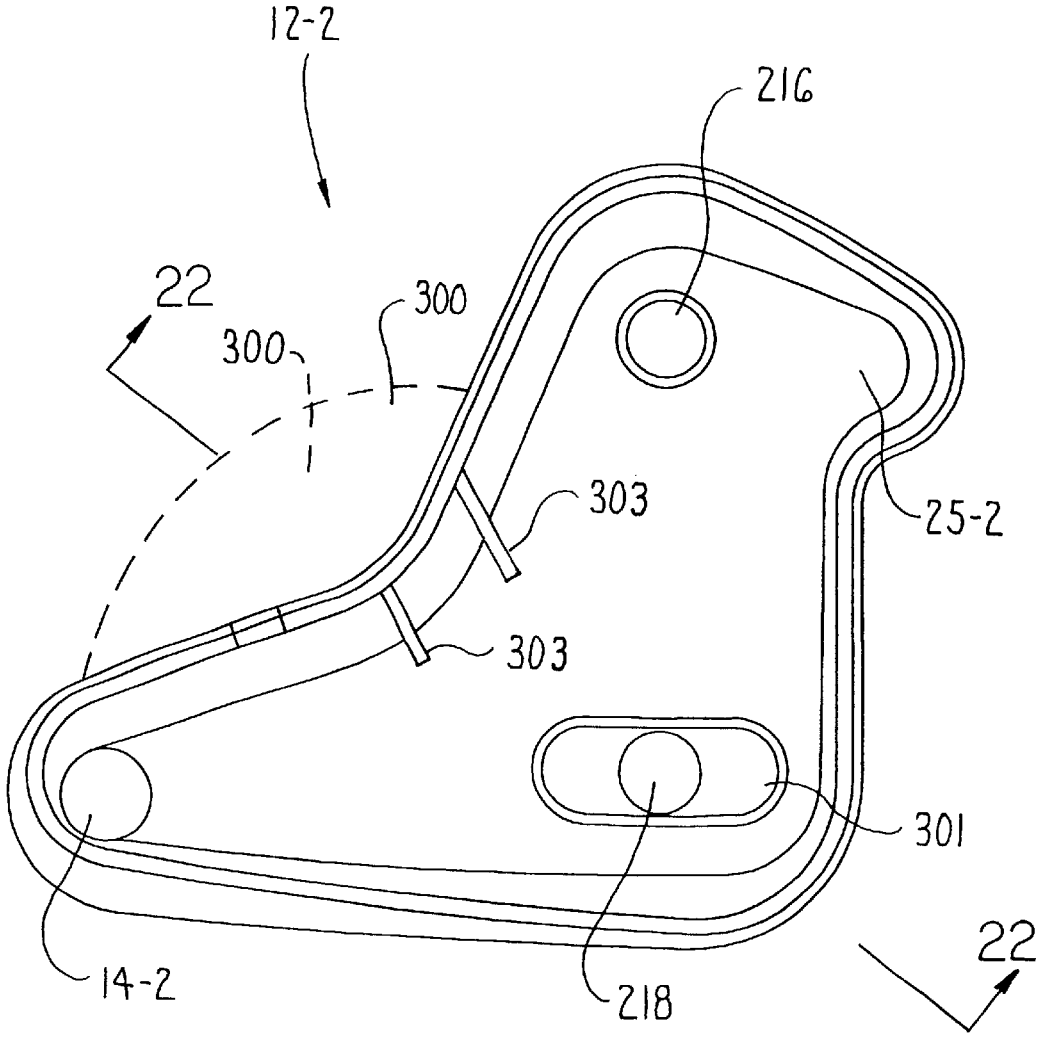
FIG. 20 is a plan view of a modified actuator lever arrangement for the chair arm of FIG. 12.
Figure 21:
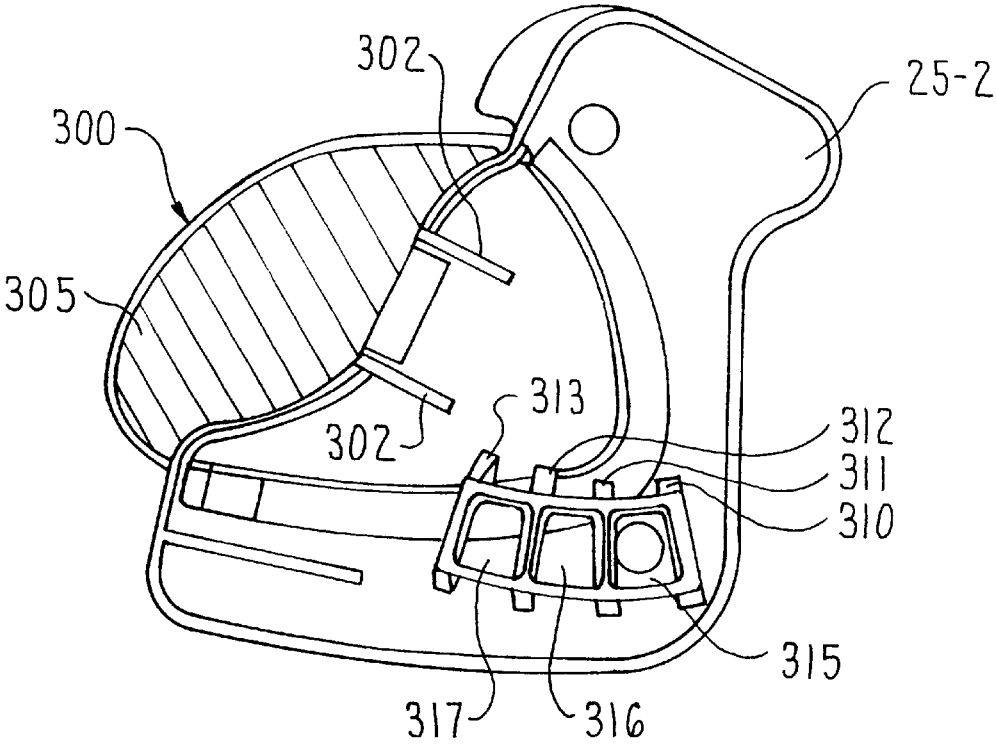
FIG. 21 is a top plan view of an actuator lever for the embodiment of FIG. 20.
Figure 22:
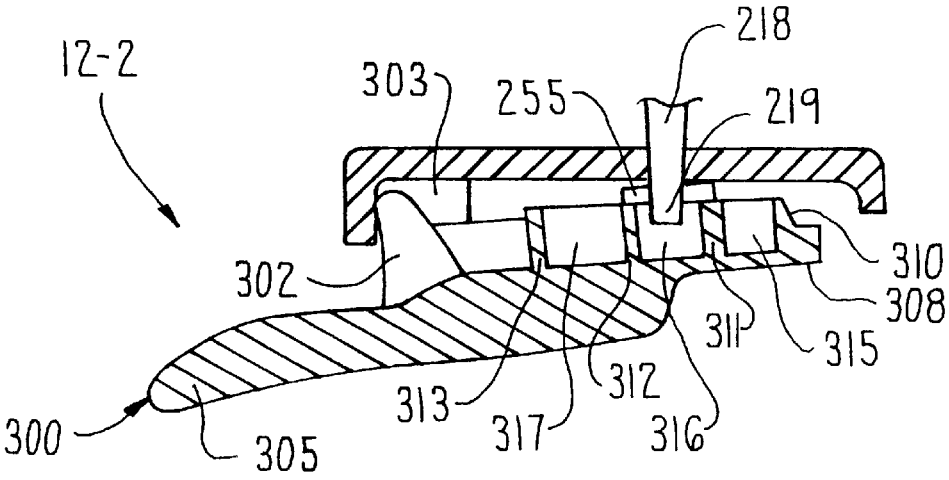
FIG. 22 is a side cross-sectional view of the actuator lever arrangement as taken along line 22—22 of FIG. 20.

Referring to FIGS. 20–22, a modified embodiment of the chair arm 12-1 is illustrated therein having improved ergonomics and specifically, an actuator lever 300 which is more readily accessible by a chair occupant.

More particularly, the modified chair arm 12-2 is functionally the same as the chair arm 12-1 except that the actuator lever 300 extends generally at an angle relative to a support post 14-2 which supports the arm rest thereon. The lever 300 thereby is accessible rearwardly of the support post 14-2 which provides improved ergonomic access to the flipper 300.

The chair arm 12-2 mounts to the pivot bolt 216 of the chair which pivot bolt 216 defines a vertical pivot axis for the chair arm 12-2 like in the chair arm 12-1. The chair arm 12-2 also cooperates with the lock bolt 218 of the chair.

The chair arm 12-2 includes a mounting bracket 25-2 which is generally L-shaped and is pivotally connected to the pivot bolt 216 and has an arcuate slot 301. The arcuate slot 301 receives the lock bolt 218 therethrough and structurally and functionally cooperates with the lock bolt 218 in the same manner as the arcuate slot 226 of the above-described chair arm 12-1. The leg of the mounting bracket 25-2 which extends sidewardly has the support post 14-2 of the arm rest projecting vertically therefrom.

The primary difference between the chair arm 12-2 and the above described chair arm 12-1 is the shape and orientation of the lever 300. The lever 300 includes upstanding pivot posts 302 (FIGS. 21 and 22) which are pivotally connected to a downwardly projecting pivot mount 303 of the mounting bracket 25-2. The actuator lever 300 thereby has a handpiece 305 which projects outwardly of the mounting bracket 25-2.

The actuator lever 300 projects generally horizontally and includes an inner distal end 308 which projects towards and cooperates with the lock bolt 218. In particular, the inside surface of the inner distal end 308 includes upstanding ribs 310, 311, 312 and 313 which define upward opening first, second and third lock cavities 315, 316 and 317 respectively. The lock cavities 315, 316 and 317 are adapted to cooperate with the head 219 of the lock bolt 218. A washer 255 is also provided on the lock bolt 218 and performs the same function as the washer 255 described above.

The first, second and third lock cavities 315, 316 and 317 thereby have a generally trapezoidal shape when viewed from above (FIG. 20) and allow pivoting of the mounting bracket 25-2 about the pivot bolt 216. By pivoting the handpiece 305 upwardly, the inner distal end 308 of the actuator lever 300 is disengaged downwardly from the lock bolt 218 to allow such pivoting of the chair arm 12-2. Thereafter, the actuator lever 300 is biased upwardly back into engagement with the lock bolt 218 which lock bolt 218 is received in one of the lock cavities 315, 316 and 317 to maintain the mounting bracket 25-2 at a selected angular position.

The chair arm 12-2 thereby provides an improved chair arm arrangement.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A chair arm for an office chair comprising:

an upright support post; and an arm assembly disposed on an upper end of said support post, said arm assembly comprising an arm housing which includes an upright column and a horizontally elongate armrest disposed at an upper end of said column, said column having an interior cavity and a vertically elongate connector member which is slidably disposed within said interior cavity such that said arm housing and said connector member are non-rotatably connected together in telescoping relation to permit adjustment of a height of said arm assembly relative to said support post, said connector member being rotatably connected to said support post so as to rotate relative thereto such that said arm housing rotates in combination with said connector member relative to said support post about a rotation axis which extends vertically.

2. The chair arm according to claim 1, wherein said arm assembly includes a lock mechanism which releasably engages said arm housing and said connector member together to maintain said arm housing at a selected height.

3. The chair arm according to claim 2, wherein said arm assembly includes an actuator connected to said lock mechanism which is manually actuatable to release and engage said lock mechanism to respectively permit and prevent vertical movement of said arm housing.

4. The chair arm according to claim 3, wherein said connector member includes a vertical row of slots each of which opens sidewardly and said lock mechanism includes a sidewardly movable lock projection which is insertable into said slots, said actuator effecting movement of said lock projection out of and into said slots to respectively permit and prevent vertical movement of said arm housing.

5. The chair arm according to claim 1, wherein one of said connector member and said support post has a cylindrical outer surface and the other of said connector member and said support post has an interior surface which defines a vertically elongate circular bore that opens vertically, one of said connector member and said support post being insertable vertically inside said circular bore of the other in telescoping engagement to permit rotation of said arm assembly.

6. The chair arm according to claim 1, wherein said connector member has a cylindrical bore which opens downwardly and rotatably receives an upper end of said support post therein, said arm assembly including a lock mechanism which engages an outer surface of said connector member to permit and prevent vertical movement of said arm housing.

7. The chair arm according to claim 6, wherein a detent arrangement is provided between said connector member and said support post to define angularly spaced apart stop positions for said arm assembly.

8. The chair arm according to claim 7, wherein said detent arrangement includes a first ring which is fixed to said upper end of said support post and a second ring which is fixed to a lower end of said connector member, said first and second rings each including an angularly elongate row of teeth which project toward each other and are matingly engaged together to define said detent positions.

9. The chair arm according to claim 8, wherein said row of teeth on each of said first and second rings is annular so that said detent positions are defined at substantially equal increments from each other through 360 degrees of rotational movement of the arm assembly.

10. The chair arm according to claim 1, wherein said arm assembly includes a lock mechanism which releasably engages said arm housing and said connector member together to maintain said arm housing at a selected height, said lock mechanism including a carrier having a pivoting lock lever which extends downwardly alongside said connector member and includes a lock projection which projects sidewardly toward a vertical row of notches defined in said connector member, said lock lever further including an upper wall which defines a downward facing abutment surface and a ramp which faces upwardly toward said abutment surface, said lock mechanism further including a vertically movable plunger which is biased downwardly into contact with said ramp by a biasing member that is compressed vertically between said abutment surface and an opposing upward facing shoulder defined on said plunger, said biasing member acting downwardly on said ramp to pivot said lock lever toward said connector member and insert said lock projection into said notches wherein said lock mechanism further includes an actuator lever which is manually movable to raise said plunger and pull said biasing member upwardly to pivot said lock lever away from said connector member and disengage said lock projection from said notches.

11. A chair arm for an office chair comprising:

an upright support post; and an arm assembly disposed on an upper end of said support post, said arm assembly comprising an arm housing having an upright column and a horizontally elongate arm rest disposed at an upper end of said column, said column having a connector member on a lower section thereof, said arm housing and said upper end of said support post being rotatably connected together by said connector member wherein said connector member defines a rotatable connection with said support post such that said arm housing and said connector member are rotatable together about a rotation axis which extends vertically, said connector member and said support post respectively including cooperating detent connector parts which define angularly spaced apart stop positions for said arm assembly during rotation thereof, said connector member being vertically movable relative to said support post and including a biasing member which biases said connector member downwardly toward said support post to maintain said connector parts in mating engagement while permitting separation of said connector parts during rotation of said arm housing.

12. The chair arm according to claim 11, wherein said detent connector parts comprise a first ring on said support post and a second ring on said connector member, said first and second rings including cooperating projections and recesses which are matingly engaged together to define said stop positions.

13. The chair arm according to claim 12, wherein said connector member is movable upwardly away from said support post during rotation of said arm assembly which separates said cooperating projections and recesses to permit said rotation.

14. The chair arm according to claim 13, wherein said arm housing is movable vertically relative to said connector member to permit adjustment of an elevation of said arm housing relative to said connector member.

15. The chair arm according to claim 11, wherein said connector parts include cooperating projections and recesses which define said stop positions.

16. The chair arm according to claim 11, wherein said arm housing is movable vertically relative to said connector member to permit adjustment of an elevation of said arm housing relative to said connector member.

17. An office chair comprising:

a seat assembly having opposite side edges which project forwardly and a bottom surface extending sidewardly between said side edges; and an arm assembly which is connected to said seat assembly and is pivotable relative thereto, said arm assembly having an L-shaped support plate which is defined by a first leg which extends generally parallel to a respective one of said side edges of said seat assembly and a second leg which projects sidewardly from said first leg such that an outer end thereof is disposed outwardly of said respective side edge, said outer end including an arm rest which projects vertically therefrom, said first leg of said support plate having a first end which is pivotally connected to said seat assembly and an opposite second end which includes an arcuate slot which extends generally sidewardly, said seat assembly including a pin which is supported on said seat assembly and projects vertically into sliding engagement with said arcuate slot such that said slot is movable along said pin with said pin being positionable along said slot in a plurality of angularly spaced apart slot positions, and said arm assembly including an actuator lever which engages said pin when said pin is in any one of said plurality of slot positions, said actuator lever being selectively disengagable from said pin to permit sideward pivoting of said support plate about said pivot axis to adjust a sideward position of said arm rest relative to said seat assembly, and said actuator lever being reengagable with said pin to maintain said arm rest in said sidewardly adjusted position.

18. An office chair comprising:

a seat assembly having opposite side edges which project forwardly and a bottom surface; and an arm assembly which is connected to said seat assembly and is pivotable relative thereto, said arm assembly having a support plate which is defined by a first leg which extends generally parallel to a respective one of said side edges of said seat assembly and a second leg which projects sidewardly from said first leg such that an outer end thereof is disposed outwardly of said respective side edge, said outer end including an arm rest which projects vertically therefrom, said first leg of said support plate having a first end which is pivotally connected to said seat assembly and an opposite second end which includes an arcuate slot which extends generally sidewardly, said seat assembly including a pin which projects vertically into sliding engagement with said arcuate slot so as to be movable through a plurality of angularly spaced apart slot positions, and said arm assembly including an actuator lever which engages said pin when said pin is in any one of said plurality of slot positions, said actuator lever being selectively disengagable from said pin to permit sideward pivoting of said support plate about said pivot axis to adjust a sideward position of said arm rest relative to said seat assembly, and said actuator lever being reengagable with said pin to maintain said arm rest in said sidewardly adjusted position, said actuator lever further including a plurality of pockets which are sidewardly adjacent to each other to engage said pin when said pin is in different ones of said angular slot positions.

19. The chair according to claim 18, wherein said actuator lever includes an exterior handpiece which is accessible by a chair occupant, said handpiece projecting from said outer end of said second leg.

20. The chair according to claim 18, wherein said actuator lever includes an exterior handpiece which is accessible by a chair occupant, said handpiece projecting outwardly from said support plate in a direction spaced angularly from said second leg.

21. The chair according to claim 18, wherein said outer end of said second leg of said support plate includes a support post projecting upwardly therefrom, said arm rest including a horizontally elongate arm support and being rotatably connected to said support post so as to be rotatable about an upright rotation axis which permits said arm support to be rotated and maintained substantially parallel to said side edge of said seat assembly in response to pivoting of said support plate.

22. The chair according to claim 21, wherein a detent arrangement is provided between said arm rest and said support post to define angularly spaced apart stop positions for said arm rest.

23. The chair according to claim 22, wherein said arm rest includes a connector member which is rotatably connected to said support post, said arm support being vertically movable relative to said connector member to permit adjustment of a height of said arm support.

24. An office chair comprising:

a seat assembly having opposite side edges which extend in a front-to-back direction and a bottom surface which extends sidewardly between said side edges in a sideward direction; and at least one arm assembly which is connected to said seat assembly and is movable sidewardly relative thereto, said arm assembly having an L-shaped support plate which is defined by a first leg which extends in said front-to-back direction generally parallel to a respective one of said side edges and a second leg which projects sidewardly from said first leg in said sideward direction such that an outer end of said second leg is disposed outwardly of said respective side edge, said outer end including an arm rest which projects vertically therefrom, said first leg of said support plate having a first end which is pivotally connected to said seat assembly such that said first and second legs pivot together in combination about a vertical pivot axis, said first leg having an opposite second end which includes an elongate arcuate slot which extends generally sidewardly, and said seat assembly including a pin which is supported on said seat assembly and projects through said arcuate slot in sliding engagement therewith, said slot being slidable along said pin during pivoting movement of said support plate wherein said pin may be positioned in any one of a plurality of angularly spaced apart slot positions located along a length of said slot, said arm assembly further including a lock device which is supported on said support plate so as to move therewith and is removably engagable with said pin to prevent pivoting of said support plate when said locking device is engaged with said pin and permit pivoting movement of said support plate when said lock device is engaged with said pin.

25. The chair according to claim 24, wherein said second leg is displaced sidewardly during pivoting of said support plate about said pivot axis to adjust a sidewardly position of said arm rest.

26. The chair according to claim 25, wherein said locking device is a lever that is pivotally connected to said support plate.

27. The chair according to claim 24, wherein said arm rest is moved closer to or farther away from said side edge during pivoting of said support plate.

* * * * *